US011242118B1

(12) United States Patent
Yob et al.

(10) Patent No.: US 11,242,118 B1
(45) Date of Patent: Feb. 8, 2022

(54) SEAT WITH RECLINING MECHANISM FOR MARINE VESSEL

(71) Applicant: Wieland Designs, Inc., Goshen, IN (US)

(72) Inventors: Michael R. Yob, Middlebury, IN (US); David T. Behles, New Paris, IN (US)

(73) Assignee: Wieland Designs, Inc., Goshen, IN (US)

( * ) Notice: Subject to any disclaimer, the term of this patent is extended or adjusted under 35 U.S.C. 154(b) by 0 days.

(21) Appl. No.: 16/937,110

(22) Filed: Jul. 23, 2020

(51) Int. Cl.
*B63B 29/04* (2006.01)

(52) U.S. Cl.
CPC ..... *B63B 29/04* (2013.01); *B63B 2029/043* (2013.01)

(58) Field of Classification Search
CPC ..... B63B 29/04; B63B 2029/043
See application file for complete search history.

(56) References Cited

U.S. PATENT DOCUMENTS 4,792,189 A * 12/1988 Shovar ..... A47C 3/12 297/452.14
5,137,328 A * 8/1992 Smith ..... A47C 1/034 297/68
5,171,063 A * 12/1992 Stidd ..... B60N 2/0717 297/344.1
6,267,071 B1 * 7/2001 Ellis ..... B63B 29/04 114/363
6,402,247 B1 * 6/2002 Schmitt ..... B60N 2/203 297/357
6,450,845 B1 * 9/2002 Snyder ..... B60N 2/002 280/735
6,584,926 B1 * 7/2003 Schmitt ..... B63B 17/02 114/361
10,322,652 B2 * 6/2019 Beasley ..... B63B 29/06
11,096,497 B2 * 8/2021 Ludwig ..... A47C 7/445
2008/0190350 A1 * 8/2008 Giannasca ..... B63B 17/0081 114/363
2014/0048008 A1 * 2/2014 Kalil ..... B63B 29/02 114/362
2017/0197531 A1 * 7/2017 Beasley ..... B60N 2/502
2018/0079469 A1 * 3/2018 Deurr ..... B63B 29/02

OTHER PUBLICATIONS

"Attwood Marine Products Collection 2021", Retrieved from internet Aug. 31, 2020 "http://www.delzer.com/oneasg/Attwood-Marine-Products-Collection-2021/", pp. 187-218.

(Continued)

*Primary Examiner* — S. Joseph Morano
*Assistant Examiner* — Jovon E Hayes
(74) *Attorney, Agent, or Firm* — Kilpatrick Townsend & Stockton LLP

(57) ABSTRACT

A marine helm seat includes a seat base positionable within a marine vessel. The marine helm seat also includes a seat back extending from the seat base in an upward direction from a longitudinal axis of the seat base. Further, the marine helm seat includes an actuation mechanism that reclines the seat back in response to a reclining force acting on the seat back. The actuation mechanism is also able to lock the seat back in a reclined position. Additionally, the actuation mechanism is positioned on an underside of the seat base.

18 Claims, 20 Drawing Sheets

(56) References Cited

OTHER PUBLICATIONS

"Attwood Marine Products: Venture Folding Fishing Seat Shell", Retrieved from internet Aug. 31, 2020, "old.attwoodmarine.com/store/product/Venture-Folding-Fishing-Seat-shell", 2 pages.
"Billfish with Flip Bolster and Pivot Arms", Retrieved from internet on Aug. 31, 2020, www.llebroc.com/product-p/4bbf.htm, 3 pages.
"BW Pick: Chris Craft Launch 27", Retrieved from internet Jul. 12, 2021 "https://www.bateswharf.co.uk/news/bw-pick-chris-craft-launch-27/", 6 pages.
"Llebroc.com—Tradewinds Series 2 Helm Chair", Retrieved from internet on Aug. 31, 2020, "https://llebroc.com/product-p/4brtrw02-.htm", 2 pages.
"Mako With Flip Bolster & Pivot Arm", Retrieved from internet Aug. 31, 2020, "https://www.llebroc.com/product-p/4bmk3001.htm", 3 pages.
"Moeller Marine Products: White 2080 Chair and Cushion Set/Mounting Plate", Retrieved from internet on Aug. 31, 2020, "www.moellermarine.com/moeller-marine/marine-accessories/white-2080-chair-and-cushion-set-mounting-plate-st2080-hd/", 3 pages.
"Research 2016—Nautique Boats—Ski Nautique 200 Open Bow", Retrieved from internet, Jul. 12, 2021 "http://boats.iboats.com/research/2016-nautique-boats-ski-nautique-200-open-bow/1645402.html", 2 pages.
"Sea Ray—SPX 210", Retrieved from internet Aug. 31, 2020 "https://www.searay.com/us/en/models/spx-series/spx-210.html", 2 pages.
"Sea Ray—SPX 210 Outboard", Retrieved from internet on Aug. 31, 2020 from "https://www.searay.com/us/en/models/spx-series/spx-210-outboard.html", 12 pages.

* cited by examiner

SEAT WITH RECLINING MECHANISM FOR MARINE VESSEL

TECHNICAL FIELD

Examples of the presently disclosed subject matter relate to marine vessels, such as watercraft and boats. In particular, the presently disclosed subject matter relates to seating for marine vessels.

BACKGROUND

Marine seats are used to provide a marine vessel operator and passengers with a supported position during operation or use of marine vessels. The marine seats may be limited in adjustability and modularity. For example, adjustable positions and components of the marine seats may be limited due to size constraints of the marine vessel or inefficient mechanisms implemented to adjust the positions of the marine seats. Further, upholstery processes provided in marine seats may limit component modularity of the marine seats.

SUMMARY

According to various aspects of the present disclosure, a marine helm seat can include a seat base positionable within a marine vessel. The marine helm seat can also include a seat back extending from the seat base in an upward direction from a longitudinal axis of the seat base. Further, the marine helm seat can include an actuation mechanism that reclines the seat back in response to a reclining force acting on the seat back. The actuation mechanism may lock the seat back in a reclined position. Additionally, the actuation mechanism may be positioned within or on an underside of the seat base.

In an additional example, an actuation mechanism of a marine helm seat may include a static end that couples to an internal surface or an underside surface of a seat base of the marine helm seat that is positionable on a marine vessel. The actuation mechanism may also include an actuating end positioned opposite the static end. The actuating end may couple to a seat back of the marine helm seat. Further, the actuation mechanism may include an actuation trigger that enables movement of the actuating end such that the seat back is able to recline, decline, or both.

In an additional example, a method of reclining a marine helm seat may include receiving a first force at an actuation trigger of the marine helm seat. The method may also include, in response to receiving the first force, transitioning an actuation mechanism to an unlocked state. The actuation mechanism may be positioned within or on an underside of a seat base and coupled between the seat base and a seat back. Further, the method may include receiving a second force on the seat back. In response to receiving the second force, the method may include moving an actuating end of the actuation mechanism coupled to the seat back toward a static end of the actuation mechanism coupled to the seat base to recline the seat back. Furthermore, in response to removal of the first force at the actuation trigger, the method may include transitioning the actuation mechanism to a locked state.

These illustrative aspects and features are mentioned not to limit or define the presently described subject matter, but to provide examples to aid understanding of the concepts described in this application. Other aspects, advantages, and features of the presently described subject matter will become apparent after review of the entire application.

DETAILED DESCRIPTION

Certain aspects and examples of the disclosure relate to seating and manufacturing of such seating for marine vessels. An example of seating for a marine vessel is a helm seat. Seating according to some examples can provide a wide variety of reclining positions and settings, modular construction without showing couplings externally, molded components, ornamental seating features, or a combination of these or other features.

Figure 1:
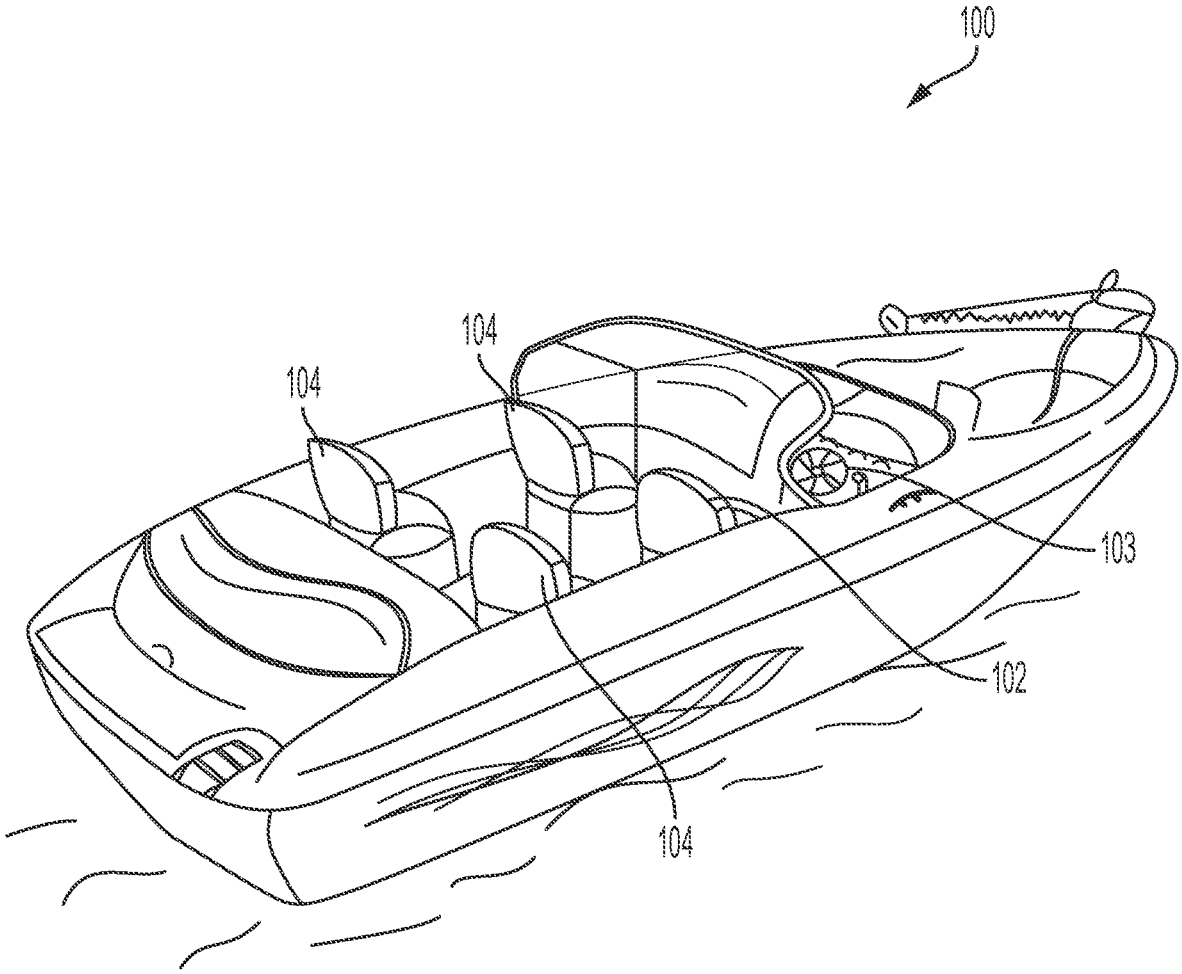
FIG. 1 is an example of a marine vessel including a marine helm seat, in accordance with one or more examples of the present disclosure.

FIG. 1 is an example of a marine vessel 100 including a marine helm seat 102, in accordance with one or more examples of the present disclosure. The marine vessel 100, which may be a boat or any other watercraft that includes the marine helm seat 102 at a helm 103 of the marine vessel 100. The helm 103 includes controls, such as steering and speed control, for directing and controlling the marine vessel 100 in water. The marine vessel 100 also includes other seats 104, which may be positions for passenger seating. While the term "helm seat" typically refers to a particular seat located at the helm 103, as used herein, the term "helm seat" may refer to a seat at any seat location on the marine vessel 100, such as at any of the seats 104. Other seat arrangements using the marine helm seat 102 may include seats mounted around a table on a pontoon boat, or seats in stern or bow areas of the marine vessel 100.

As discussed in detail below with respect to FIGS. 2-8, the marine helm seat 102 may include an actuation mechanism that enables a reclining and declining function of the marine helm seat 102. Further, as discussed in detail below with respect to FIGS. 9 and 10, the marine helm seat 102 may include releasable and modular components. Moreover, as discussed in detail below with respect to FIGS. 11-13, the modular components of the marine helm seat 102 may include integral components, such as headrests or lumbar supports, such that the overall design of the marine helm seat 102 may be easily changed.

Seat with Reclining Mechanism for Marine Vessel Marine helm seats, such as seats 102, 104 in the marine vessel 100 of FIG. 1, can recline and decline. In particular, the marine helm seat 102 can include one or more actuation mechanisms positioned on an underside or within a seat base of the marine helm seat 102. The actuation mechanisms, which may be gas spring cylinders, can be used to lock a seat back of the marine helm seat 102 in a desired reclined or declined position. In an example, the actuation mechanisms may be an individual gas spring cylinder positioned along a longitudinal axis on the underside or within the seat base. In another example, the actuation mechanisms may include two or more gas spring cylinders that are positioned equidistant from the longitudinal axis on the underside or within the seat base on either side of the longitudinal axis. The central or balanced positioning of the actuation mechanisms may enable balanced force on hinging points of the marine helm seat 102 to prevent twisting during engagement of the actuation mechanisms with the seat back. The use of multiple actuation mechanisms may also enable balanced force on helm seating applications for high-capacity, large occupant seats or multiple seating position seats.

Marine helm seats may rely on automotive-type control of the marine helm seats, such as using a ratchet and a spring mounted pivot to provide a reclining function to the marine helm seat. Such a design has limited positioning variability. That is, the recline or decline of those marine helm seats may be limited to ratchet locations of an automotive-type control mechanism. Other marine helm seat designs may rely on friction locks to maintain a reclining position of the marine helm seats. Friction locks may rely on significant manual interaction for operation, such as manual screwing and unscrewing of friction locking elements to lock and unlock a position of the marine helm seats. By using an actuation mechanism according to some examples of the present disclosure, a wide variety of variable recline and decline positions can be achieved.

Figure 2:
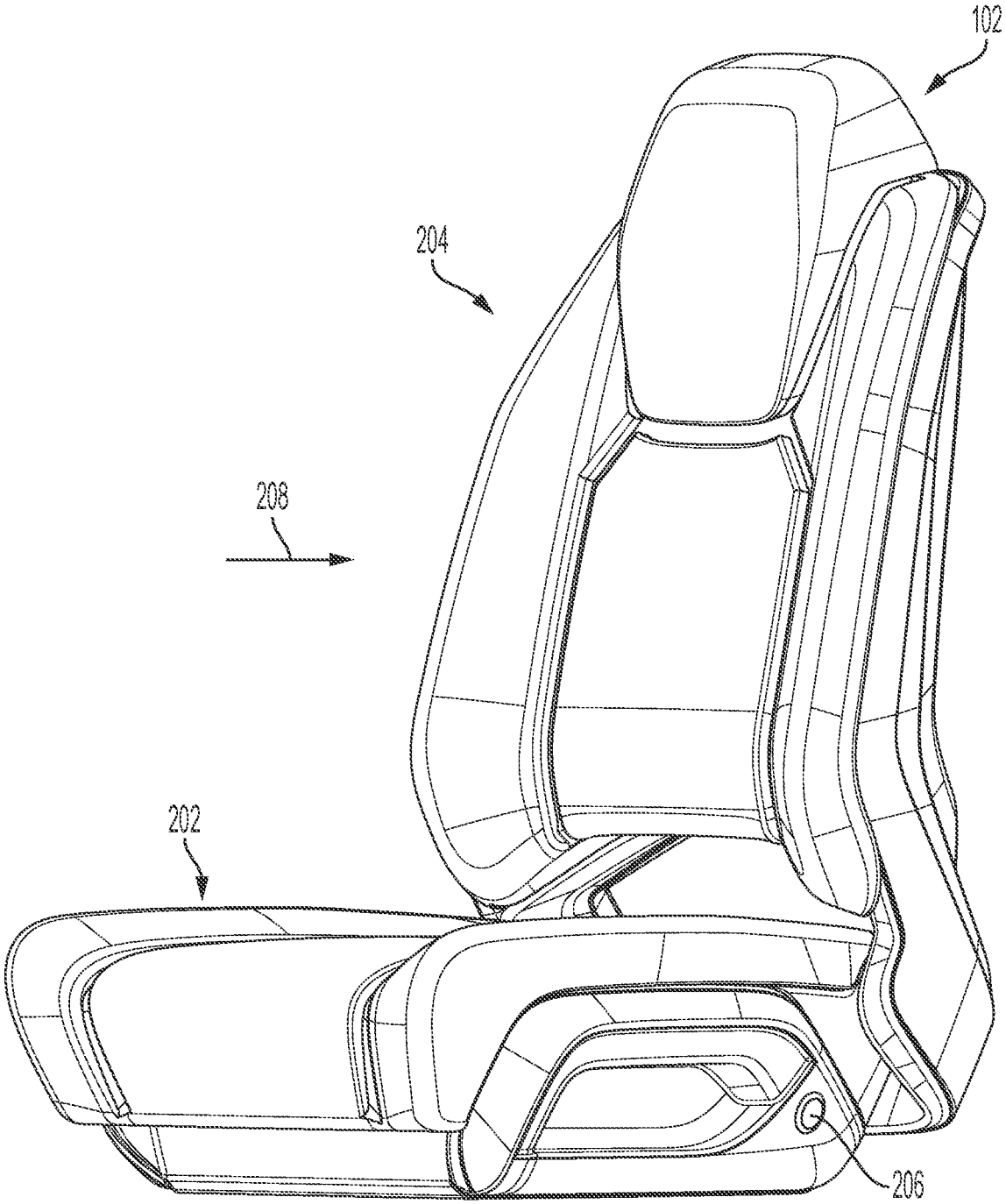
FIG. 2 is a perspective view of an example of the marine helm seat from FIG. 1, in accordance with one or more examples of the present disclosure.

FIG. 2 is a perspective view of an example of the marine helm seat 102 that can include an actuation mechanism for reclining and declining the seat, in accordance with one or more examples of the present disclosure. The marine helm seat 102 may include a seat base 202 and a seat back 204. As illustrated, the seat back 204 extends in a vertical direction from the seat base 202.

The seat base 202 may include an actuation trigger 206, such as a push-button actuator of a Bowden wire release. By depressing the actuation trigger 206, an actuation mechanism may be unlocked to enable reclining or declining of the seat back 204. The actuation mechanism may be a locking gas spring cylinder that is biased toward a declined position, as shown in FIG. 2. When the actuation trigger 206 is depressed, the locking gas spring cylinder may unlock in a manner that a reclining force applied in a direction 208 results in a reclining movement of the seat back 204. Once a desired reclining position is reached, the actuation trigger 206 may be released to lock the seat back 204 in place at an occupant selectable position.

Figure 3:
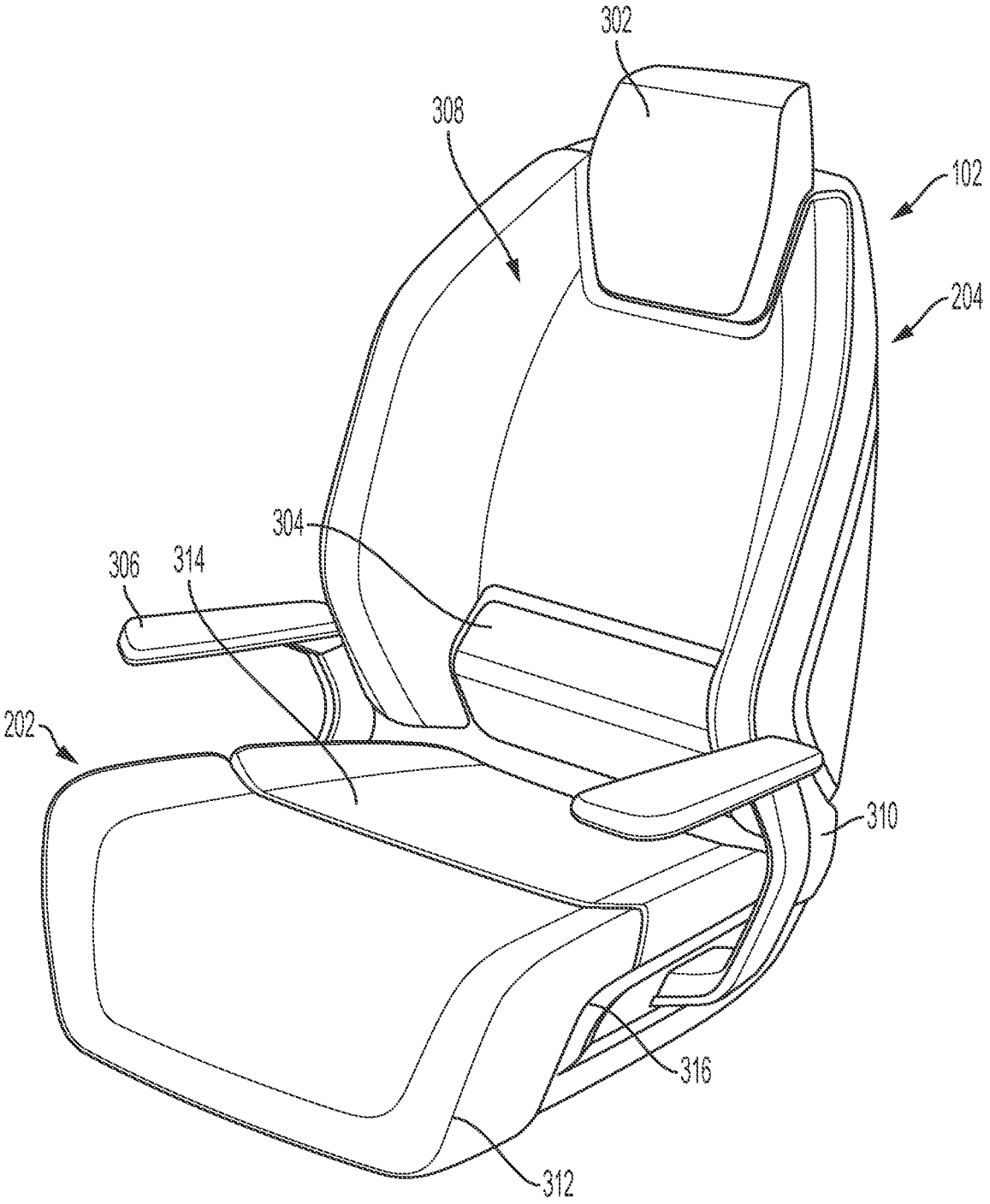
FIG. 3 is a perspective view of an additional example of a marine helm seat, in accordance with one or more examples of the present disclosure.

FIG. 3 is a perspective view of an additional example of the marine helm seat 102, in accordance with one or more examples of the present disclosure. As shown, the marine helm seat 102 may include a headrest 302, a lumbar support 304, and arm rests 306. In an example, the headrest 302, the lumbar support 304, or both may be integrated into an upholstered, molded foam carrier 308. The upholstered, molded foam carrier 308 may also include coupling features that couple to a frame 310 of the seat back 204 in a hidden and removable manner, as described in detail below with respect to FIGS. 7-9. In this manner, the upholstered, molded foam carrier 308 may be a modular component that is easily installable to and removable from the frame 310. In some examples, the upholstered, molded foam carrier 308 includes a thermoformed substrate, such as a molded carrier 1100 described below with respect to FIG. 11, attached to a layer of foam and including a textile upholstery covering. Other materials may also be used as the upholstery covering, and other molding processes may be used to generate the molded carrier 1100.

The seat base 202 may include a bolster 312. The bolster 312 can rotate in such a manner to be positioned on a rear portion 314 of the seat base 202. In this manner, the bolster 312 may provide an operator of the marine vessel 100 with a higher vantage point while operating the marine vessel 100. Similar to the seat back 204, the seat base 202 may include upholstery installed on a molded upholstery foam carrier. The molded upholstery foam carrier of the seat base 202 may also include coupling features that couple to a frame 316 of the seat base 202 in a hidden and removable manner. In this manner, the molded upholstery foam carrier of the seat base 202 may also be a modular component that is easily installable to and removable from the frame 316.

In one or more examples, the frames 310 and 316 may be made from a rotocast technique. As used herein, the term rotocast may refer to a method of manufacturing particular components of the marine helm seat 102. For example, the frames 310 and 316 may be formed from a heated thermoplastic resin that conforms to a shape of a rotated container while the heated thermoplastic resin cools. By generating components of the marine helm seat 102 using a rotocast technique, the various components of the marine helm seat 102 may be generated efficiently and in a manner that enables joining of seat components in a modular manner with many possible variations. Other casting or molding techniques may also be used to form the frames 310 and 316.

By integrating the headrest 302, the lumbar support 304, or both into the upholstered, molded foam carrier 308, options for modularly assembling the marine helm seat 102 may be provided. For example, the marine helm seat may be built from the frame 310 of the seat back 204 and the frame 316 from the seat base 202. The molded upholstery foam carriers of the seat back 204 and the seat base 202 with different integrated features may be installed on the frame to achieve a particular design of the marine helm seat 102. For example, the marine helm seat 102 may be built with the headrest 302, the lumbar support 304, or both by changing the upholstered, molded foam carrier 308 installed on the frame 310.

As used herein, the term "thermoformed" may refer to an additional method of manufacturing particular components of the marine helm seat 102. For example, the upholstered, molded foam carrier 308 may include a thermoformed component that is formed from a heated thermoplastic resin that conforms to a shape of mold while the heated thermoplastic resin cools. By generating components of the marine helm seat 102 using a thermoformed technique, the various components of the marine helm seat 102 may be generated efficiently and in a manner that also enables joining of seat components in a modular manner with many possible variations. Other molding techniques may also be used to form the upholstered, molded foam carrier 308.

Figure 4:
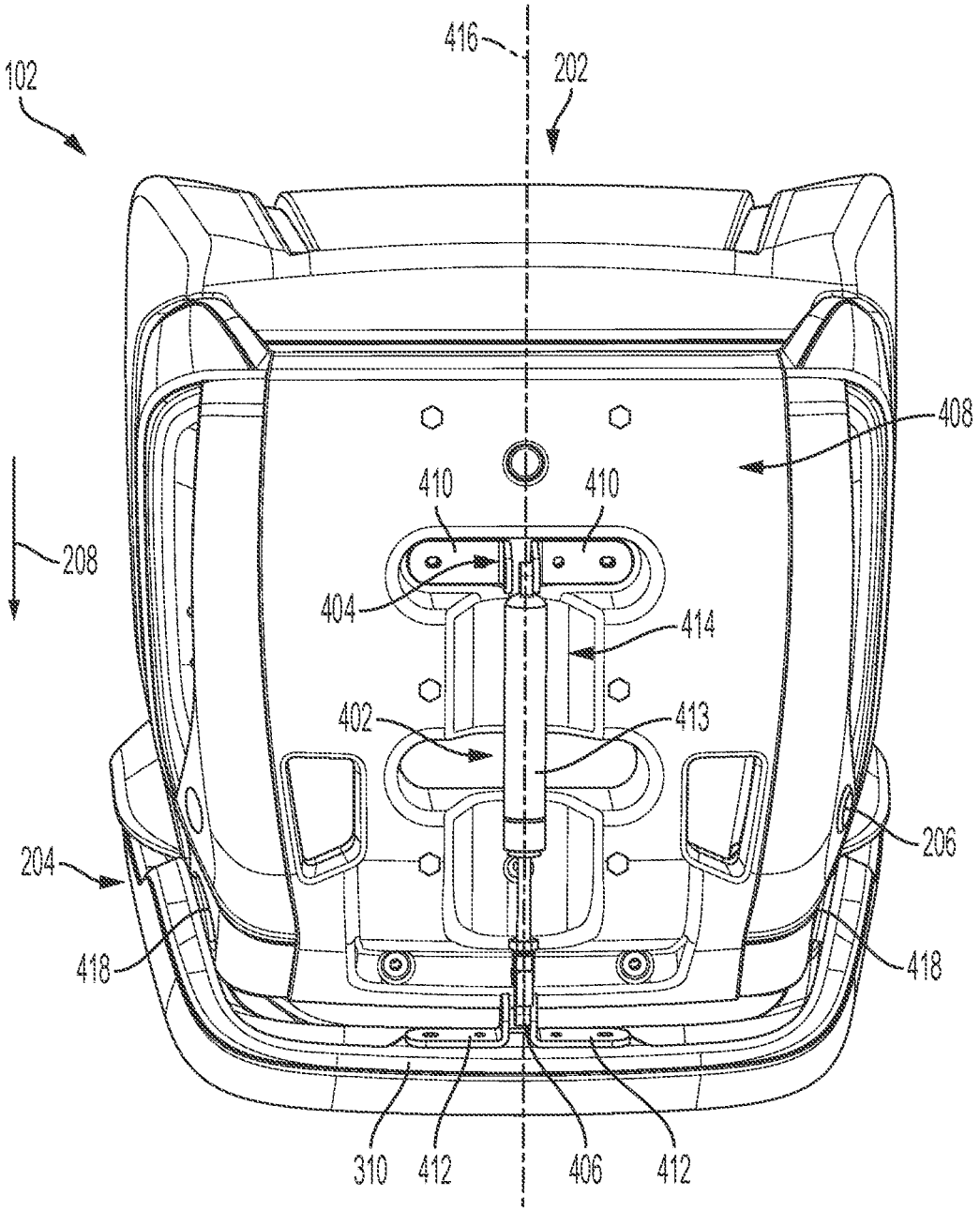
FIG. 4 is a bottom view of a marine helm seat including an actuation mechanism, in accordance with one or more examples of the present disclosure.

FIG. 4 is a bottom view of the marine helm seat 102 including an actuation mechanism 402, in accordance with one or more examples of the present disclosure. The actuation mechanism 402 may include a static end 404 and an actuating end 406. The static end 404 may couple to an underside 408 of the seat base 202 of the marine helm seat 102. In an example, the static end 404 may couple to the seat base 202 using perpendicular brackets 410 that provide life-cycle strength to distribute a load of the actuation mechanism 402 across a larger area of the seat base 202. The actuation mechanism 402 may also be positioned within the seat base 202.

The actuating end 406 may be positioned on the actuation mechanism 402 opposite the static end 404. The actuating end 406 may couple to the seat back 204 of the marine helm seat 102. In an example, the actuating end 406 may couple to the frame 310 of the seat back 204 using perpendicular brackets 412 that provide life-cycle strength to distribute a load of the actuation mechanism 402 across a larger area of the frame 310.

The actuation trigger 206, such as a button or plunger of a Bowden wire release mechanism, may be depressed to enable movement of the actuating end 406 of the actuation mechanism 402. By enabling movement of the actuating end 406 of the actuation mechanism 402, the seat back 204 is able to recline and decline. For example, the actuation mechanism 402 may include a locking gas spring cylinder 413 that locks when the actuation trigger 206 is released and unlocks when the actuation trigger 206 is depressed. While the actuation mechanism 402 is unlocked, the seat back 204 may move to a declined position when no force is applied to the seat back 204, and the seat back 204 may move to a reclined position when a reclining force is applied to the seat back 204 in the direction 208. The reclining force may be any force applied in the direction 208 that overcomes a biasing force of the actuation mechanism 402.

In the illustrated example, the static end 404 at least partially resides within a depression 414, or tunnel, running along a longitudinal axis 416 on the underside 408 of the seat base 202. Further, the actuating end 406 may also reside at least partially within the depression 414. The actuating end 406 may recline the seat back 204 when the actuating end 406 moves toward the static end 404 of the actuation mechanism 402. Additionally, the actuating end 406 may decline the seat back 204 when the actuating end 406 moves away from the static end 404 of the actuation mechanism 402.

In an additional example, an opposite orientation of the actuation mechanism 402 may be employed. That is, the actuating end 406 may be arranged such that the actuating end 406 declines the seat back 204 when the actuating end 406 moves toward the static end 404 of the actuation mechanism 402. Additionally, the actuating end 406 may recline the seat back 204 when the actuating end 406 moves away from the static end 404 of the actuation mechanism 402.

In some examples, an additional actuation mechanism 402 may be positioned on the underside 408 of the seat base 202 to tailor the marine helm seat 102 to a desired reclining strength. In such an example, the two actuation mechanisms 402 may be positioned equidistant from the longitudinal axis 416 and on either side of the longitudinal axis 416. In such an example, the two actuation mechanisms 402 may reside, at least partially, within two separate depressions 414 within the underside 408 of the seat base 202. In an additional example, the two actuation mechanisms 402 may reside, at least partially, within an individual depression 414 that extends between the two actuation mechanisms 402. In one or more examples, all of the actuation mechanisms 402 may reside within the seat base 202 such that they are encapsulated by the seat base 202. In other examples, one or more actuation mechanisms 402 may be positioned within the seat base 202 while one or more additional actuation mechanisms 402 may be positioned within the depression 414 within the underside 408 of the seat base 202.

Further, additional actuation mechanisms 402, such as three or more actuation mechanisms, may also be positioned on the underside 408 of the seat base 202 or within the seat base 202. The actuation mechanisms 402 may be arranged to be equally spaced on either side of the longitudinal axis 416 to evenly apply a rotational force on hinges 418 between the seat base 202 and the seat back 204. The hinges 418 may be post and socket hinge couplings. In an example with an odd number of actuation mechanisms 402, one of the actuation mechanisms may be placed along the longitudinal axis 416, as illustrated in FIG. 4.

Figure 5:
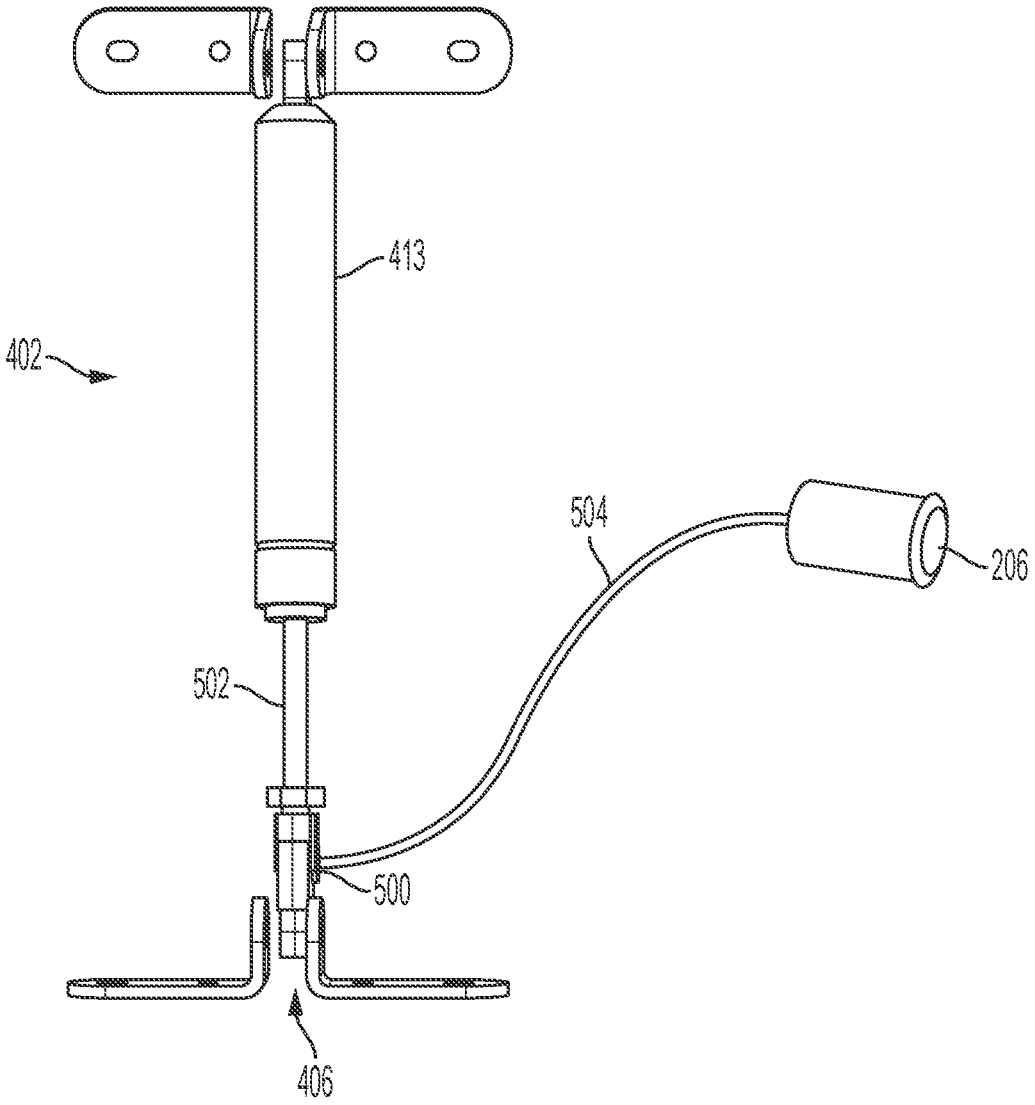
FIG. 5 is a bottom view of the actuation mechanism of FIG. 4, in accordance with one or more examples of the present disclosure.

FIG. 5 is an example of the actuation mechanism 402, in accordance with one or more examples of the present disclosure. As discussed above, the actuation mechanism 402 may be the locking gas spring cylinder 413 with the actuation trigger 206. The actuation trigger 206 may be communicatively coupled to a release mechanism 500 that operates by unlocking the locking gas spring cylinder 413 when a new reclining position of the marine helm seat 102 is desired.

For example, the actuation trigger 206 may be depressed to transition the actuating end 406 of the locking gas spring cylinder 413 to an unlocked state from the locked state. Transitioning the actuating end 406 to the unlocked state may enable movement of a rod 502 into and out of the locking gas spring cylinder 413. When the actuation trigger 206, such as a plunger, is depressed, a wire 504 provides an actuating force on the release mechanism 500 to release the actuating end 406 from the locked state in response to depression of the actuation trigger 206. In an example, the wire 504 communicatively couples the actuation trigger 206 to the release mechanism 500. In some examples, the actuation trigger 206 and the wire 504 combine to form a Bowden wire release mechanism.

The actuation trigger 206 may subsequently be released for the actuating end 406 to return to the locked state. For example, removing the depressing force from the actuation trigger 206 may result in the actuating force provided from the wire 504 to the release mechanism 500 to also be removed. By removing the actuating force on the release mechanism 500, the actuating end 406 may return to the locked state to limit any further movement until the actuation trigger 206 is depressed again.

Figure 6:
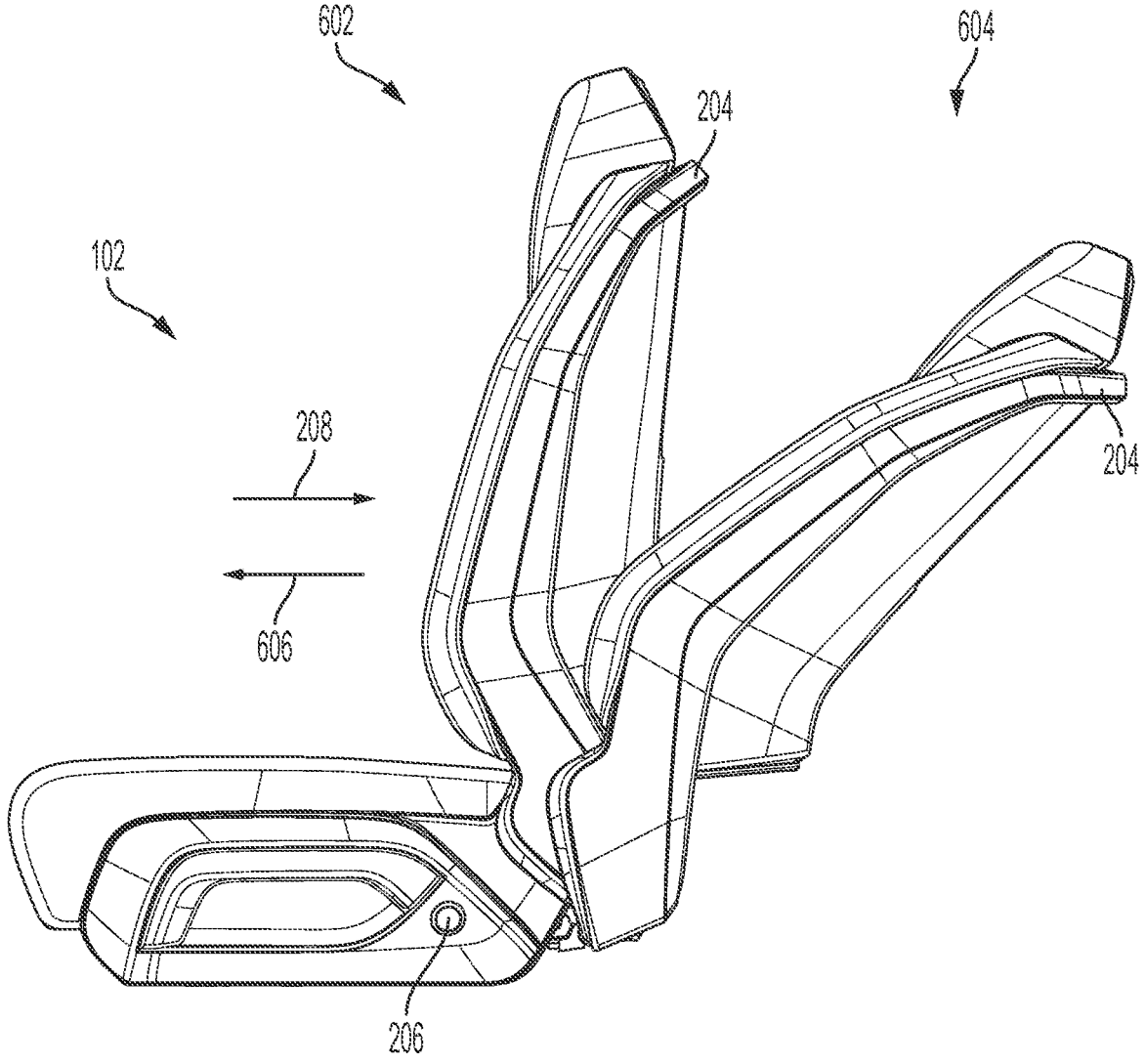
FIG. 6 is a side view of a marine helm seat movable from a declined position to a reclined position, in accordance with one or more examples of the present disclosure.

FIG. 6 is a side view of the marine helm seat 102 moving from a declined position 602 to a reclined position 604, in accordance with one or more examples of the present disclosure. Depressing the actuation trigger 206 may unlock the actuation mechanism 402 and a force applied in the direction 208 may cause the marine helm seat 102 to move from the declined position 602 to the reclined position 604. In an embodiment where the actuation mechanism 402 includes a locking gas spring cylinder 413, the movement of the seat back 204 is not limited to ratcheted or otherwise limited positions. That is, the seat back 204 may have infinite positioning variability within the range of motion of the actuation mechanism 402.

When the marine helm seat 102 is in the reclined position 604, depressing the actuation trigger 206 without any force applied in the direction 208 may cause the seat back 204 to move in a direction 606 to the declined position 602. The direction 606 may be a result of a biasing direction of the actuation mechanism 402. For example, the locking gas spring cylinder 413 may be biased in such a manner that the seat back 204 moves in the direction 606 when a reclining force is not applied to the seat back 204 in the direction 208.

Figure 7:
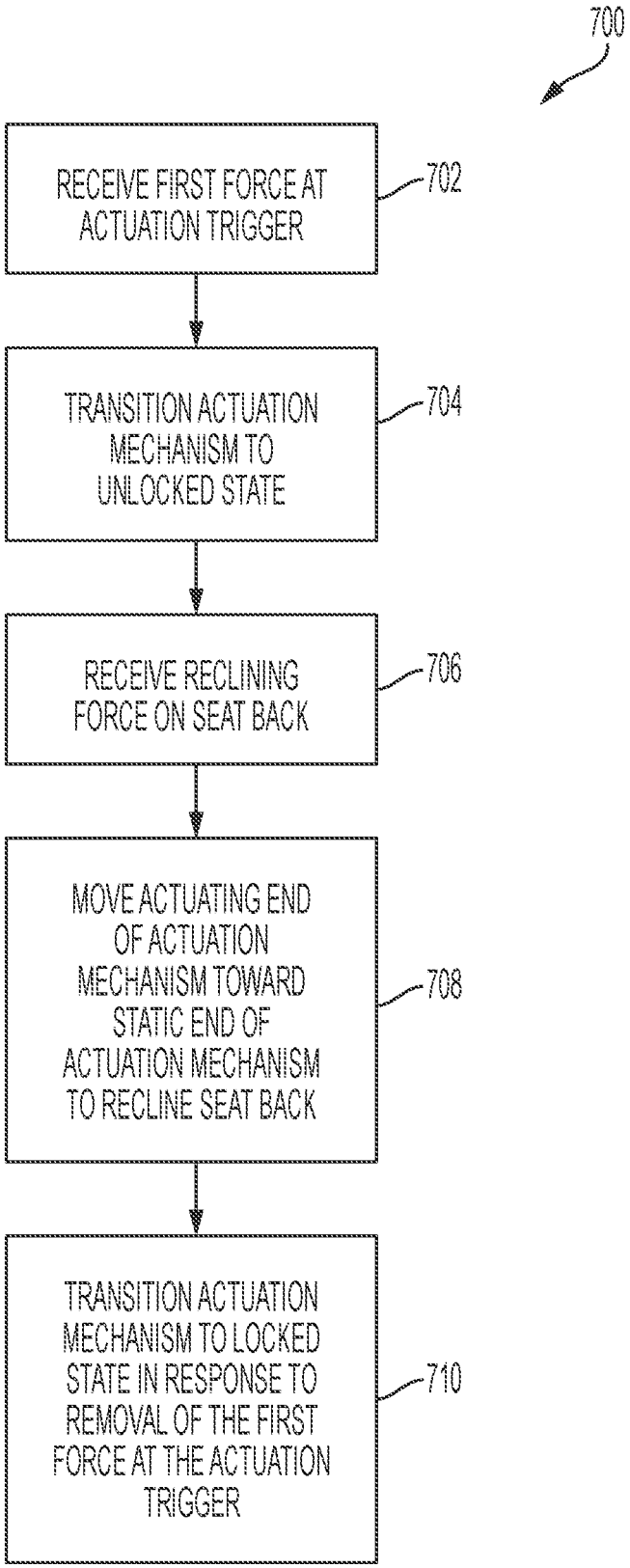
FIG. 7 is a flowchart of a process for reclining a marine helm seat, in accordance with one or more examples of the present disclosure.

FIG. 7 is a flowchart of a process 700 for reclining the marine helm seat 102, in accordance with one or more examples of the present disclosure. At block 702, the process 700 involves receiving a first force at the actuation trigger 206. The first force may be applied to the actuation trigger 206 by an occupant of the marine helm seat 102. In an example, the first force may include a depressing force on a plunger of a Bowden wire release mechanism.

At block 704, the process 700 involves transitioning the actuation mechanism 402 to an unlocked state. In an example where the actuation mechanism 402 includes the locking gas spring cylinder 413, the first force applied to the actuation trigger 206 may result in the actuation mechanism transitioning to the unlocked state. For example, the Bowden wire release mechanism may interact with a release mechanism 500 of the actuation mechanism 402 to transition the actuation mechanism to the unlocked state.

At block 706, the process 700 involves receiving a reclining force on the seat back 204. The reclining force may include an occupant of the marine helm seat 102 leaning in a reclining direction within the marine helm seat 102 toward the seat back 204. The reclining force may be a force that exceeds a biasing force of the actuation mechanism 402.

At block 708, the process 700 involves moving the actuating end 406 of the actuation mechanism 402 toward the static end 404 of the actuation mechanism 402. Because the actuating end 406 is attached to a bottom portion of the frame 310 of the seat back 204, moving the actuating end 406 toward the static end 404 causes the bottom portion of the frame 310 to pivot around the hinges 418 and toward the static end 404 of the actuation mechanism 402. The result of this movement of the frame 310 is reclining of the seat back 204.

At block 710, the process 700 involves transitioning the actuation mechanism 402 to a locked state in response to removal of the first force at the actuation trigger 206. Transitioning the actuation mechanism 402 to the locked state may maintain the marine helm seat 102 in the reclined position 604 by locking the actuation mechanism 402 in place.

Figure 8:
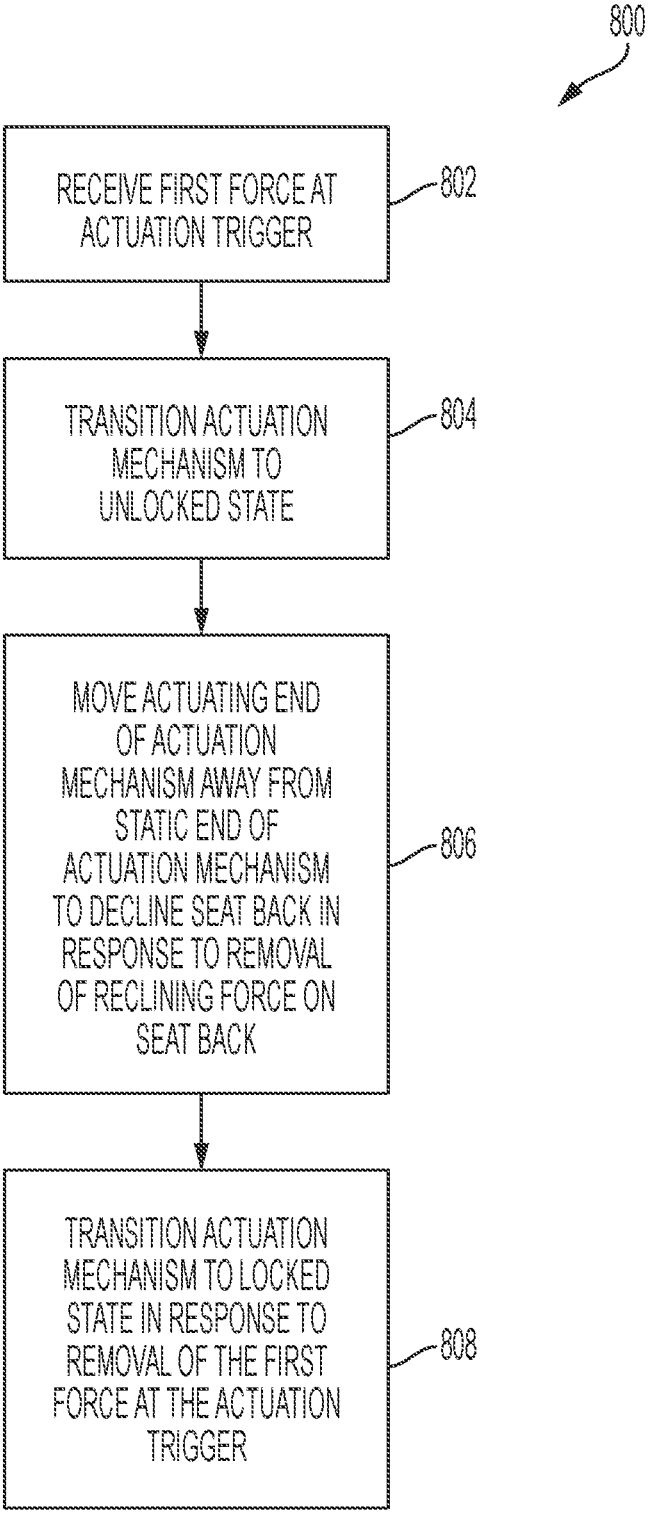
FIG. 8 is a flowchart of a process for declining a marine helm seat, in accordance with one or more examples of the present disclosure.

FIG. 8 is a flowchart of a process 800 for declining the marine helm seat 102, in accordance with one or more examples of the present disclosure. At block 802, the process 800 involves receiving a first force at the actuation trigger 206. The first force may be applied to the actuation trigger 206 by an occupant of the marine helm seat 102. In an example, the first force may include a depressing force on a plunger of a Bowden wire release mechanism.

At block 804, the process 800 involves transitioning the actuation mechanism 402 to an unlocked state. In an example where the actuation mechanism 402 includes the locking gas spring cylinder 413, the first force applied to the actuation trigger 206 may result in the actuation mechanism transitioning to the unlocked state. For example, the Bowden wire release mechanism may interact with a release mechanism 500 of the actuation mechanism 402 to transition the actuation mechanism to the unlocked state.

At block 806, the process 800 involves moving the actuating end 406 of the actuation mechanism 402 away from the static end 404 of the actuation mechanism 402 to automatically decline the seat back 204 in response to removal of the reclining force on the seat back 204. Because the actuating end 406 is attached to the bottom portion of the frame 310 of the seat back 204, moving the actuating end 406 away the static end 404 causes the bottom portion of the frame 310 to pivot around the hinges 418 and away the static end 404 of the actuation mechanism 402. The result of this movement of the frame 310 is declining of the seat back 204.

At block 808, the process 800 involves transitioning the actuation mechanism 402 to a locked state in response to removal of the first force at the actuation trigger 206. Transitioning the actuation mechanism 402 to the locked state may maintain the marine helm seat 102 in the reclined position 604 by locking the actuation mechanism 402 in place.

Seat for Marine Vessel with Releasable Modular Components

Seating systems according to some examples can include releasable modular components for ease of manufacture or maintenance of a marine helm seat. In particular, the marine helm seats can include a frame that is attachable to one or more modular components. By enabling attachment of the modular components, the marine helm seats are capable of customization during assembly of the marine helm seats, and different modular components can be upholstered or otherwise assembled in a separate assembly line from each other. Further, the modular components of the marine helm seats are easily replaceable if noticeable wear is present on the modular components. The releasable modular components may be used on the reclining marine helm seat described above with respect to FIGS. 1-8 and also in conjunction with the modular components with integral features described below with respect to FIGS. 11-13. In other examples, the releasable modular components may be used independently from the reclining helm seat and the modular components with integral features.

Standard marine helm seats are often upholstered by installing cushioning on a frame and upholstering the entire seat in one upholstering operation. Such a technique limits modularity of the seat, limits removal and replacement of individual seat components, and limits component customization. Further, because the seats are assembled as an individual object, several process bottlenecks may occur in a seat assembly process resulting in inefficiencies. By implementing marine helm seats with releasable modular components, the individual modular components may be assembled and installed without reliance on assembly and installation of other components of the marine helm seats. Thus, process inefficiencies may be avoided.

Figure 9:
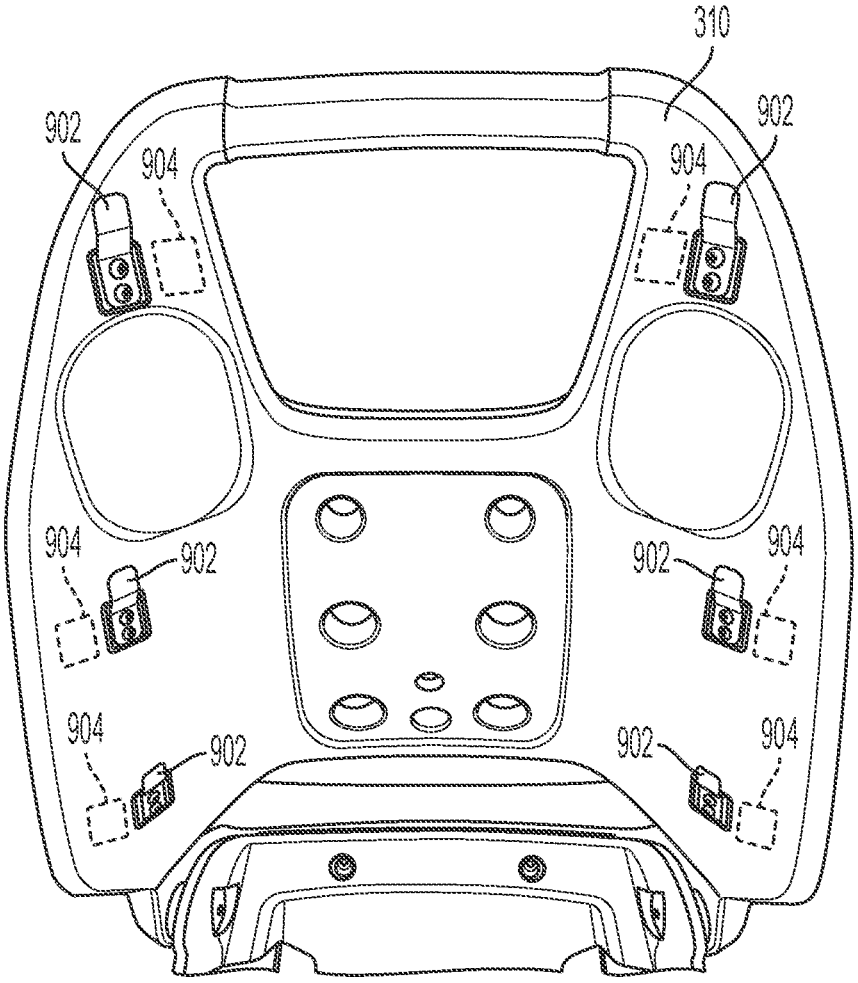
FIG. 9 is a front view of a frame of a seat back of a marine helm seat including engagement clips, in accordance with one or more examples of the present disclosure.

FIG. 9 is an example of a front view of the frame 310 of the seat back 204 of the marine helm seat 102, in accordance with one or more examples of the present disclosure. The frame 310 includes engagement clips 902 that are arranged around the frame 310 to engage with cutouts of the upholstered, molded foam carrier 308, as described below with respect to FIG. 10. In an example, the engagement clips 902 may be compression clips, z-clips, spring clips, or any other fasteners capable of providing an engaging force with the upholstered, molded foam carrier 308. To prevent inadvertent decoupling of the frame 310 and the upholstered, molded foam carrier 308, hook-and-loop fasteners 904, or other fasteners in addition to the engagement clips 902, may be positioned in varying locations on the frame 310. While FIG. 9 depicts six engagement clips 902 and six hook-and-loop fasteners 904, more or fewer of each may also be implemented on the frame 310. In an example, the hook-and-loop fasteners 904 may entirely replace the engagement clips 902 on the frame 310. Likewise, in an additional example, the engagement clips 902 may be implemented without any hook-and-loop fasteners 904. Both the engagement clips 902 and the hook-and-loop fasteners 904 may provide a mechanism for removable attachment between the frame 310 and the upholstered, molded foam carrier 308.

In some examples, the frame 310 may include additional engagement clips 902 on a side opposite the one depicted in FIG. 9. That is, the additional engagement clips 902 may be installed on a rear facing side of the seat back 204. The additional engagement clips 902 may be used to removably attach additional elements of the marine helm seat 102 to the rear facing side of the seat back 204. For example, panels may be removably attached to the rear facing side of the frame 310 that include map pockets or other storage compartments. In some examples, the panels attachable to the rear facing side of the frame 310 may also include upholstery. Similar to the upholstered, molded foam carrier 308, the panels may be made using molding techniques and subsequently upholstered or installed as molded.

Similar engagement clips 902 and hook-and-loop fasteners 904 may also be positioned on the frame 316 of the seat base 202. The molded, upholstery foam carrier of the seat base 202 may be installed on the frame 316 of the seat base 202 in a manner similar to the installation of the upholstered, molded foam carrier 308 to the frame 310.

Figure 10:
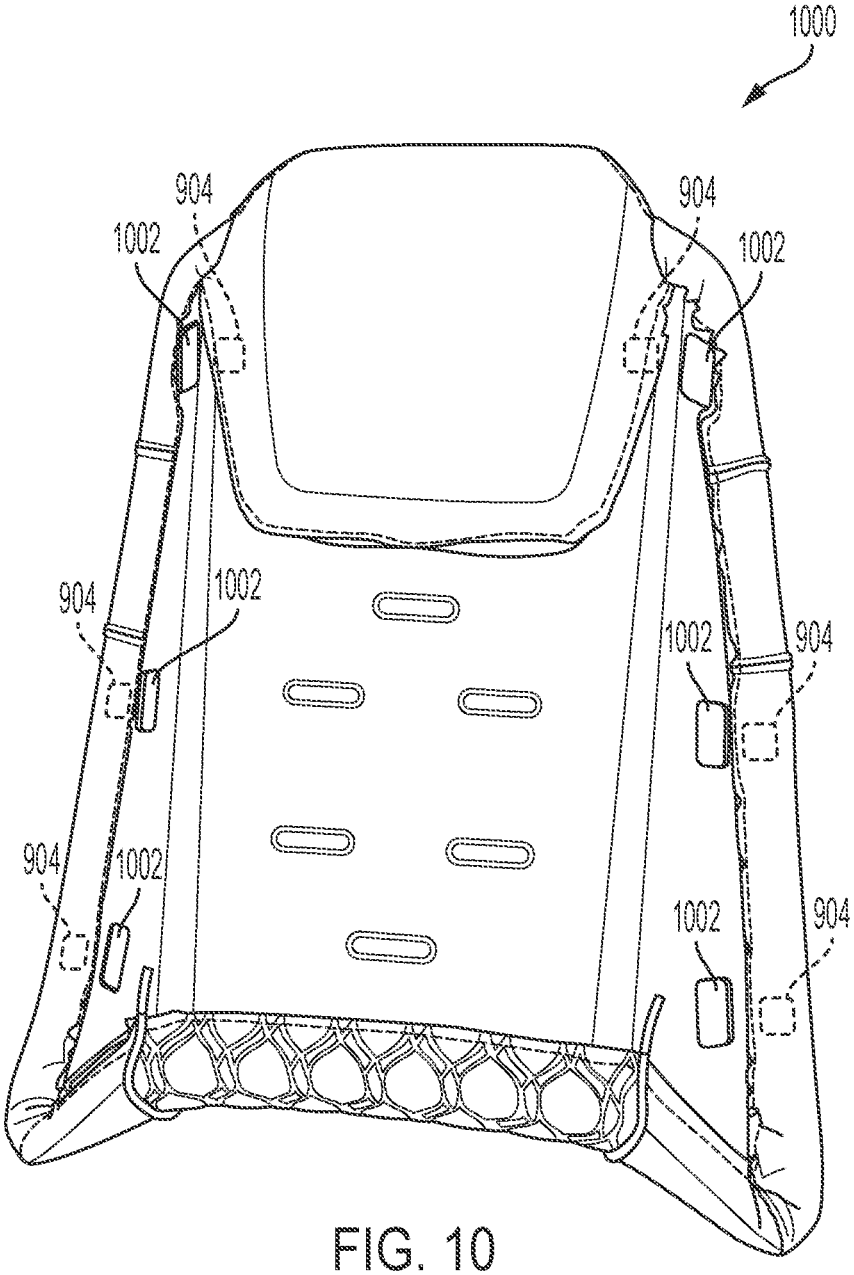
FIG. 10 is a rear view of an upholstery component of the marine helm seat that couples to the frame of the seat back, in accordance with one or more examples of the present disclosure.

FIG. 10 is an example of a rear view of an upholstery component 1000, which may be a modular component, of the marine helm seat 102 that couples to the frame 310 of the seat back 204, in accordance with one or more examples of the present disclosure. In an example, the upholstery component 1000 may be the upholstered, molded foam carrier 308 of the seat back 204. The upholstery component 1000 may include cutouts 1002 that are positioned to interact with the engagement clips 902 on the frame 310. The upholstery component 1000 may also include hook-and-loop fasteners 904 that align with the hook-and-loop fasteners 904 attached to the frame 310.

Because the upholstered, molded foam carrier 308, such as the upholstery component 1000, of the seat back 204 and the molded foam carrier of the seat base 202 may be thermoformed components that are not built integrally into the frame 310, the molded foam carriers may be upholstered separately. For example, an assembly line may be established to upholster the upholstered, molded foam carrier 308 of the seat back 204, and a separate assembly line may be established to upholster the molded foam carrier of the seat base 202.

Upon completion of the upholstering process, the molded components may be modularly installed on the frame 310 and the frame 316 of the marine helm seat 102. This modular installation may support modular replacement of parts as components of the marine helm seat 102 begin to show wear or damage. Further, the installation using the engagement clips 902 of the frames 310 and 316 and the cutouts 1002 of the upholstery components 1000 provides coupling of components with attachment locations that are not visible once installation is complete. Further, such an installation of components may maintain removability of the seat components of the marine helm seat 102.

Modular Components with Integral Features for Marine Vessel Seats Marine helm seats according to some examples can include one or more modular components with features integrated into a frame of the modular component. For example, the modular components may include a headrest, a lumbar support, or a combination thereof integrated into the frame of the modular component. In one or more examples, the modular components with integral features may be used on the reclining marine helm seat described above with respect to FIGS. 1-8 and also as releasable modular components of the marine helm seat described above with respect to FIGS. 9 and 10. In other examples, the modular components with integral features may also be used in any other marine seats, including non-reclining marine seats.

Standard marine helm seats are often upholstered by installing cushioning on a frame and upholstering the entire seat in one upholstering operation. Such a technique limits modularity of the seat, limits removal and replacement of individual seat components, and limits component customization. Further, additional components, such as headrests or lumbar supports, may increase overall costs and assembly complexity. By integrating the headrests or lumbar supports into a frame of a modular component of the marine helm seat, different arrangements of the marine helm seat may be easily achieved with minimal additional costs and complexity.

Figure 11:
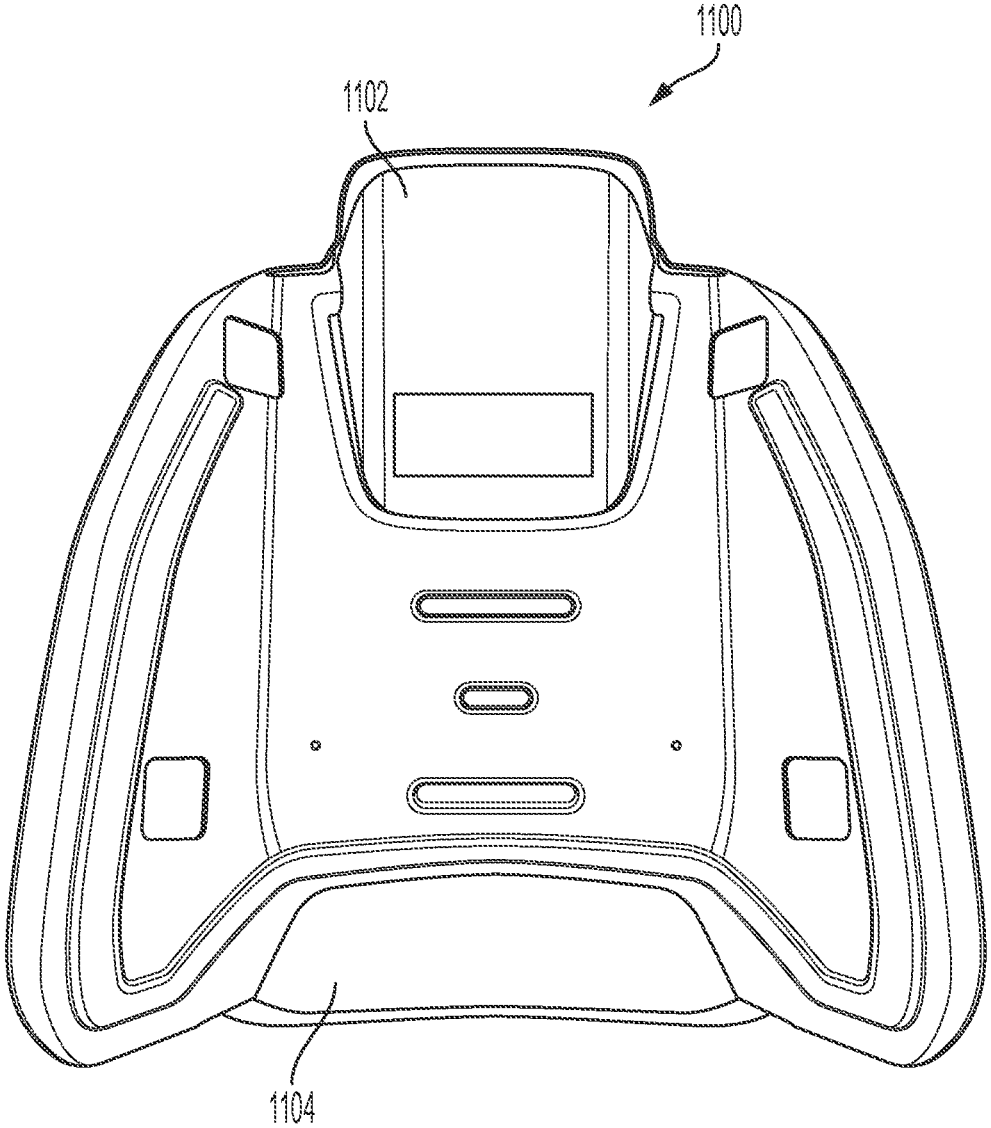
FIG. 11 is a front view of a molded carrier of the upholstery component of FIG. 10, in accordance with one or more examples of the present disclosure.

FIG. 11 is an example of a front view of a molded carrier 1100 of the upholstery component 1000 of FIG. 10, in accordance with one or more examples of the present disclosure. As illustrated, the molded carrier 1100 has not been upholstered. Upon completion of an upholstering process of the molded carrier 1100, the component may be referred to as the upholstered, molded foam carrier 308, as described above with respect to FIG. 3.

An integral headrest 1102, an integral lumbar support 1104, or both may be included as part of the molded carrier 1100. By including one or more of the integral headrest 1102 and the integral lumbar support 1104, the frame 310 of the marine helm seat 102 may be used for a number of modular options for the seat back 204 depending on the features that are integrated into the molded carrier 1100. Further, the integral headrest 1102 and the integral lumbar support 1104 may be upholstered in the same upholstering operation as the remainder of the seat back 204, but separately from the remainder of the upholstered components of the marine helm seat 102. This may limit bottlenecks in the assembly process of the marine helm seat 102.

Figure 12:
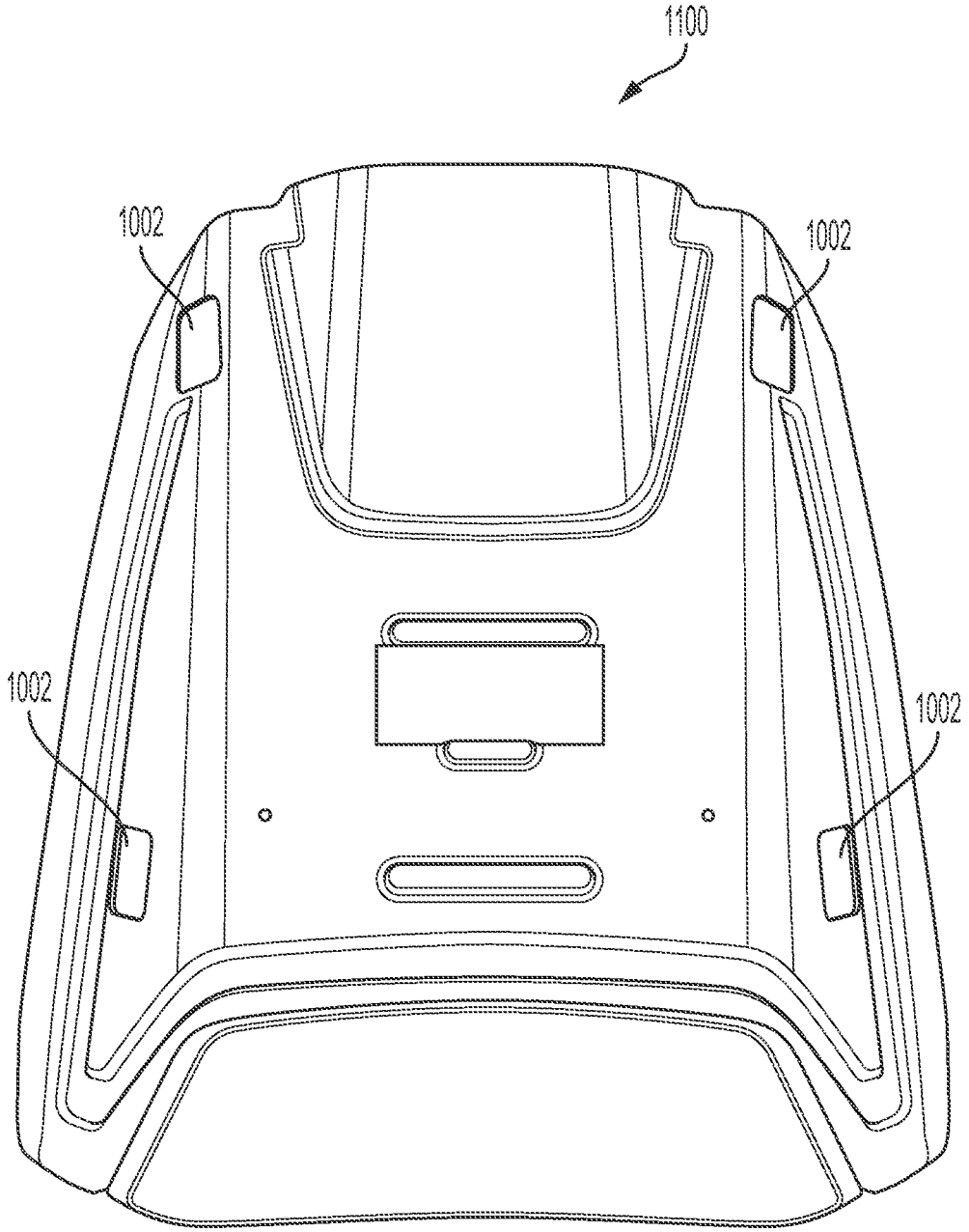
FIG. 12 is a rear view of the molded carrier of FIG. 11, in accordance with one or more examples of the present disclosure.

FIG. 12 is an example of a rear view of the molded carrier 1100 of FIG. 11, in accordance with one or more examples of the present disclosure. In the illustrated example, the cutouts 1002 are positioned in an arrangement to mate with four engagement clips 902 of the frame 310 upon completion of an upholstering operation of the molded carrier 1100.

Figure 13:
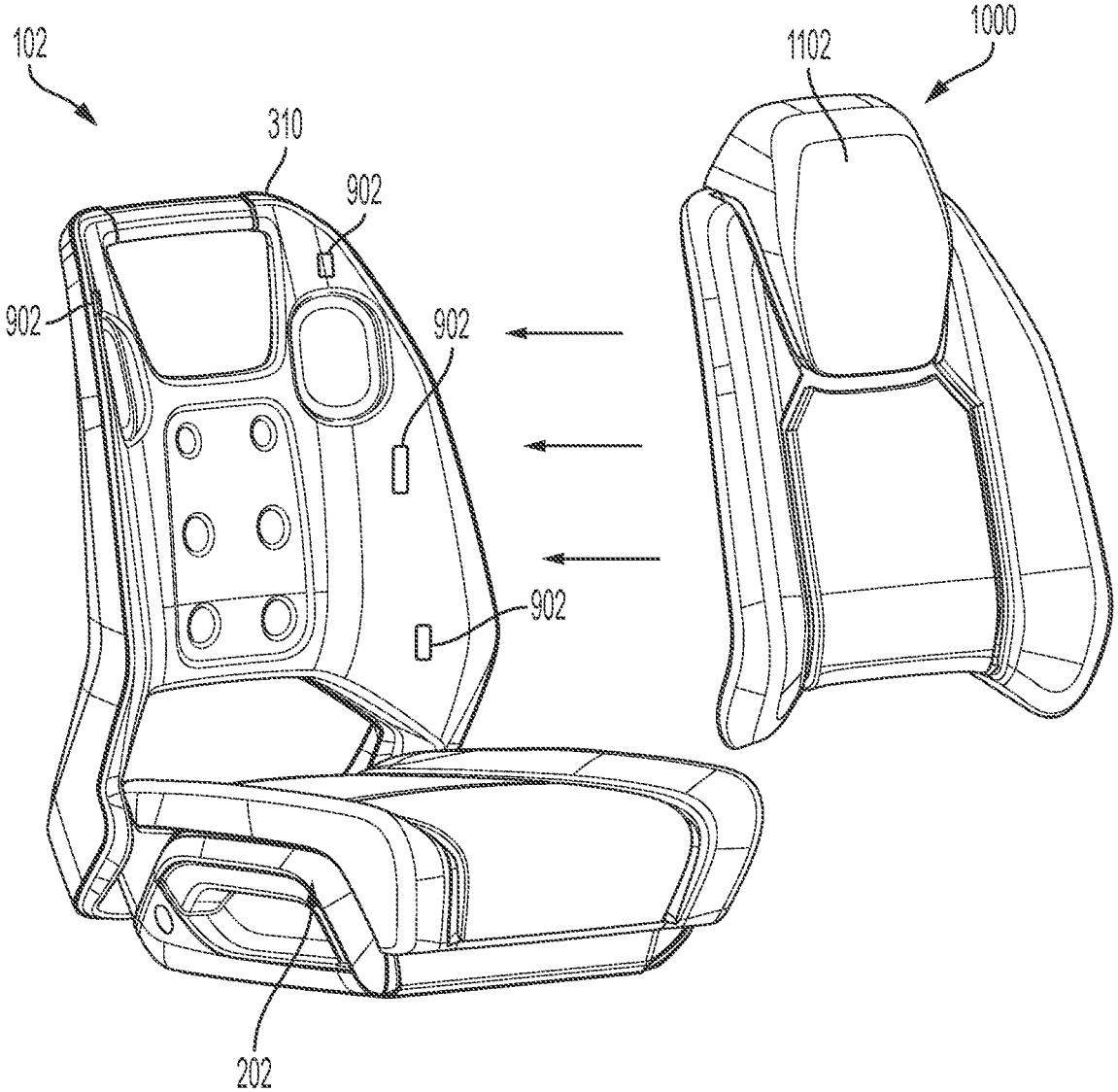
FIG. 13 is a partially exploded view of the marine helm seat including the upholstery component of FIG. 10 and the frame of the seat back of FIG. 9, in accordance with one or more examples of the present disclosure.

FIG. 13 is a partially exploded view of the marine helm seat 102 including the upholstery component 1000 and the frame 310 of the seat back 204, in accordance with one or more examples of the present disclosure. As shown, the marine helm seat 102 is already assembled with the seat base 202. To complete the marine helm seat 102, the upholstery component 1000 is installed using the engagement clips 902 of the frame 310. Any other installation order of the modular components of the marine helm seat 102 is also contemplated. Further, a marine helm seat 102 without the integral headrest 1102 may be installed by replacing the upholstery component 1000 with a different upholstery component lacking the integral headrest 1102. The integral lumbar support 1104 may similarly be added or removed by replacing the upholstery component 1000.

Ornamental Features of a Marine Vessel Seat

According to some examples, the look of a marine helm seat may include ornamentally distinct features. The reclining marine helm seat described above with respect to FIGS. 1-8, the releasable modular components of the marine helm seat described above with respect to FIGS. 9 and 10, and the modular components with integral features described above with respect to FIGS. 11-13 can all be implemented in seats that look similar to or different from the marine helm seat described below with respect to FIGS. 14-20.

Figure 14:
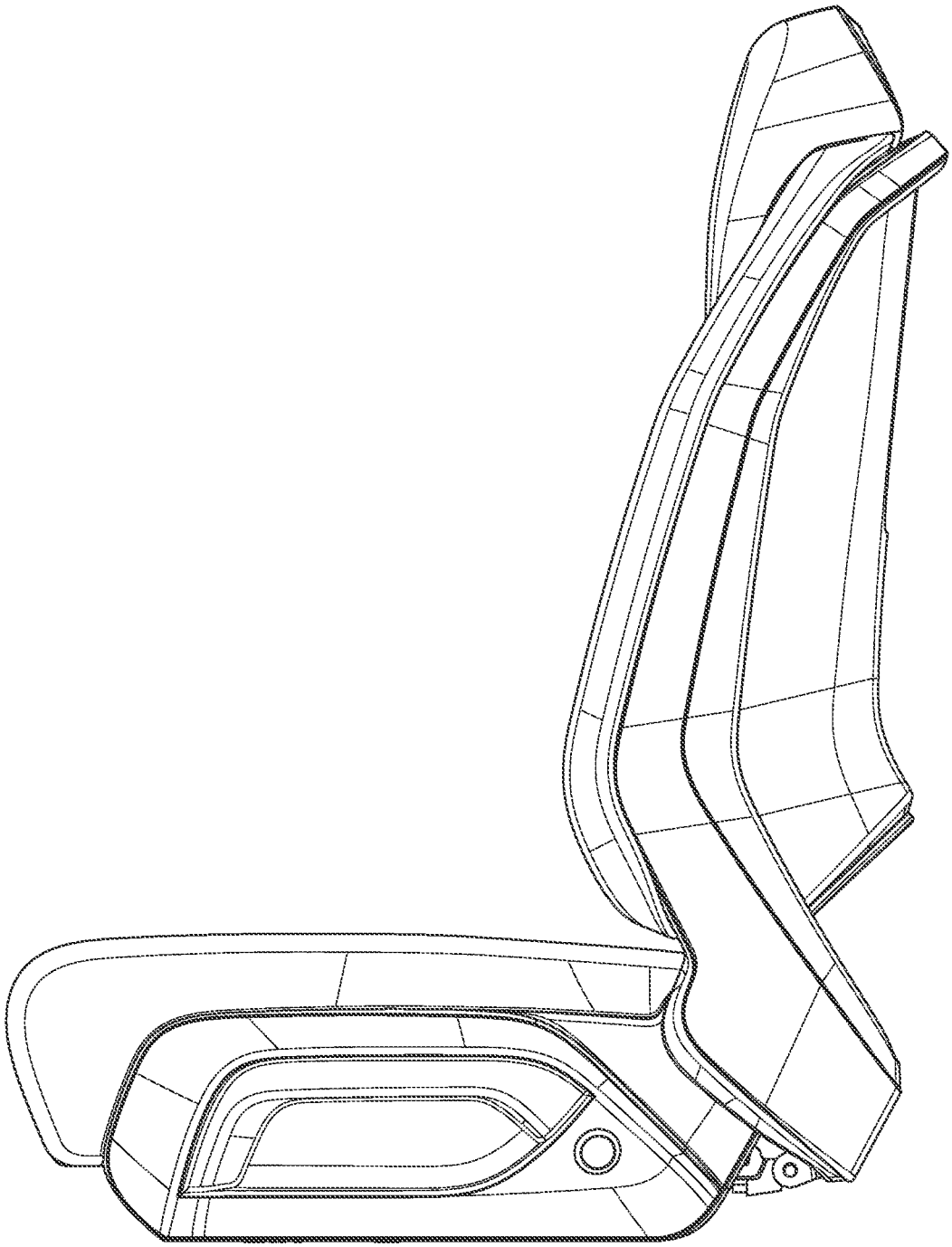
FIG. 14 is a side view of a first side of a marine helm seat including ornamental features of the marine helm seat, in accordance with one or more examples of the present disclosure.

FIG. 14 is a side view of a first side of a marine helm seat including ornamental features of the marine helm seat, in accordance with one or more examples of the present disclosure.

Figure 15:
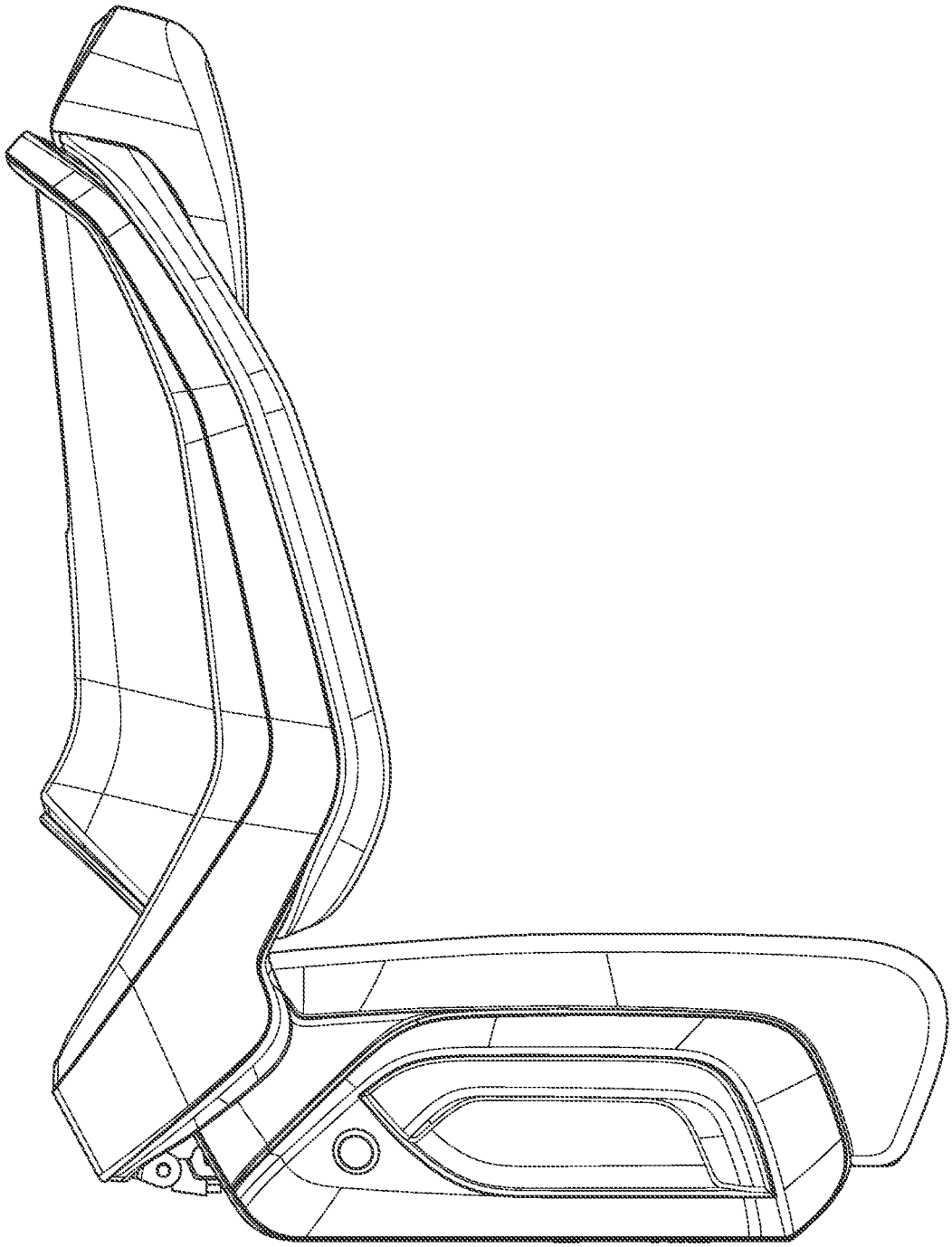
FIG. 15 is a side view of an opposite side of the marine helm seat of FIG. 14 including ornamental features of the marine helm seat, in accordance with one or more examples of the present disclosure.

FIG. 15 is a side view of an opposite side of the marine helm seat of FIG. 14 including ornamental features of the marine helm seat, in accordance with one or more examples of the present disclosure.

Figure 16:
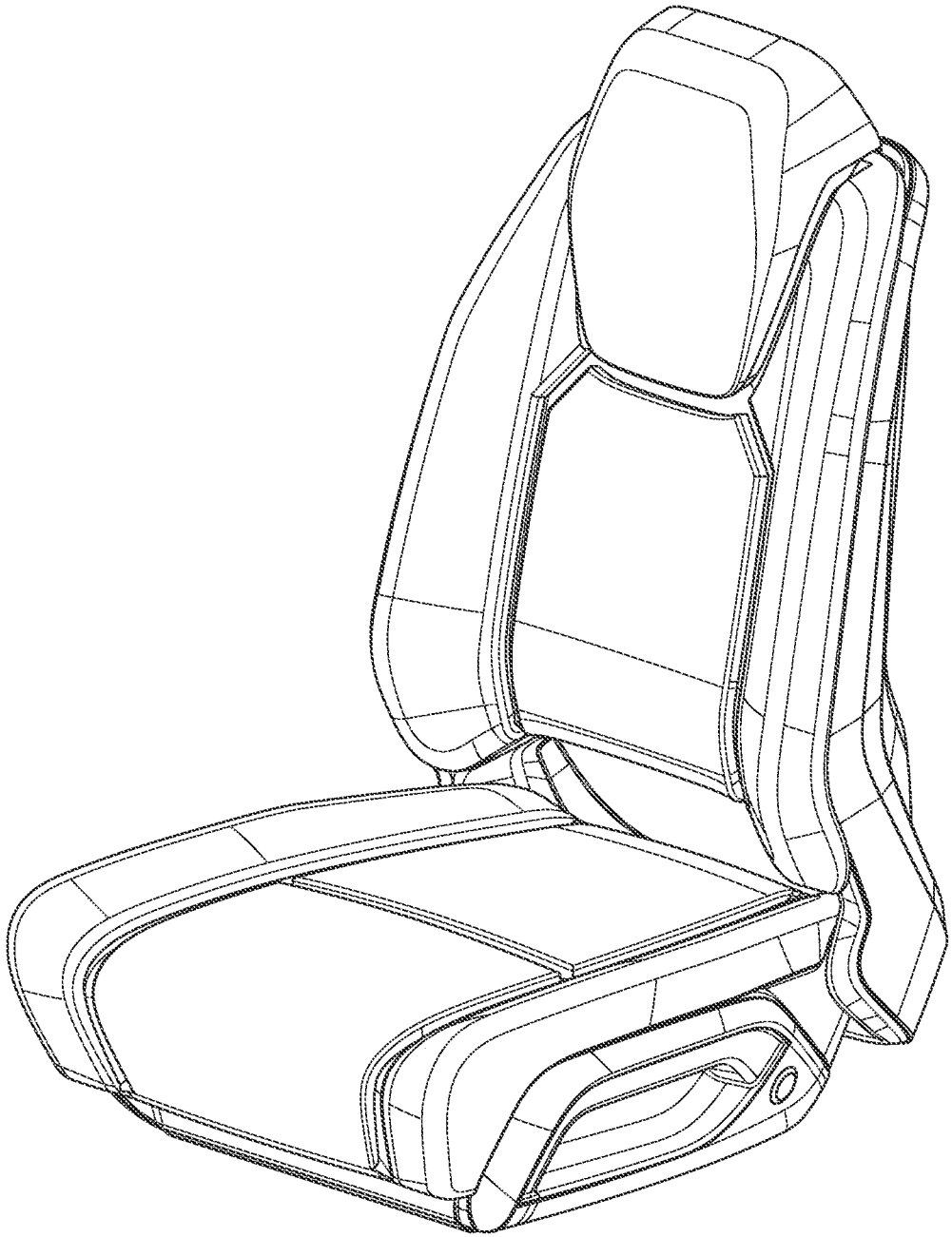
FIG. 16 is a perspective view of the marine helm seat of FIG. 14 including ornamental features of the marine helm seat, in accordance with one or more examples of the present disclosure.

FIG. 16 is a perspective view of the marine helm seat of FIG. 14 including ornamental features of the marine helm seat, in accordance with one or more examples of the present disclosure.

Figure 17:
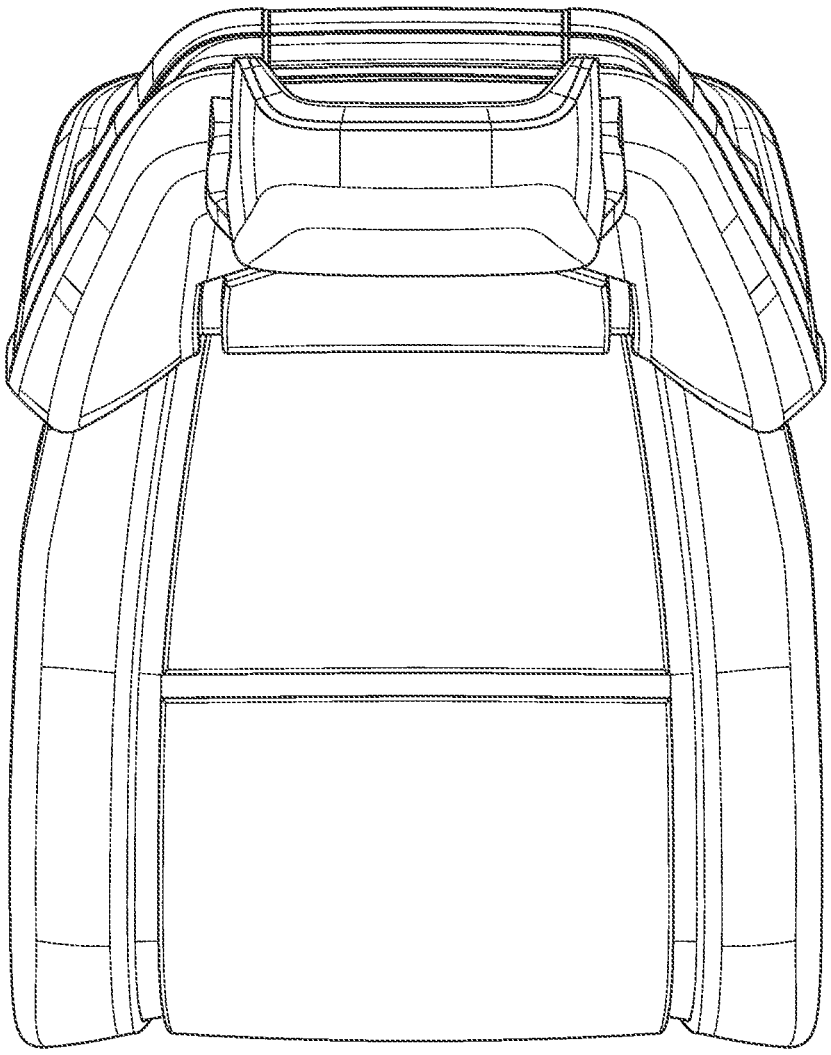
FIG. 17 is a top view of the marine helm seat of FIG. 14 including ornamental features of the marine helm seat, in accordance with one or more examples of the present disclosure.

FIG. 17 is a top view of the marine helm seat of FIG. 14 including ornamental features of the marine helm seat, in accordance with one or more examples of the present disclosure.

Figure 18:
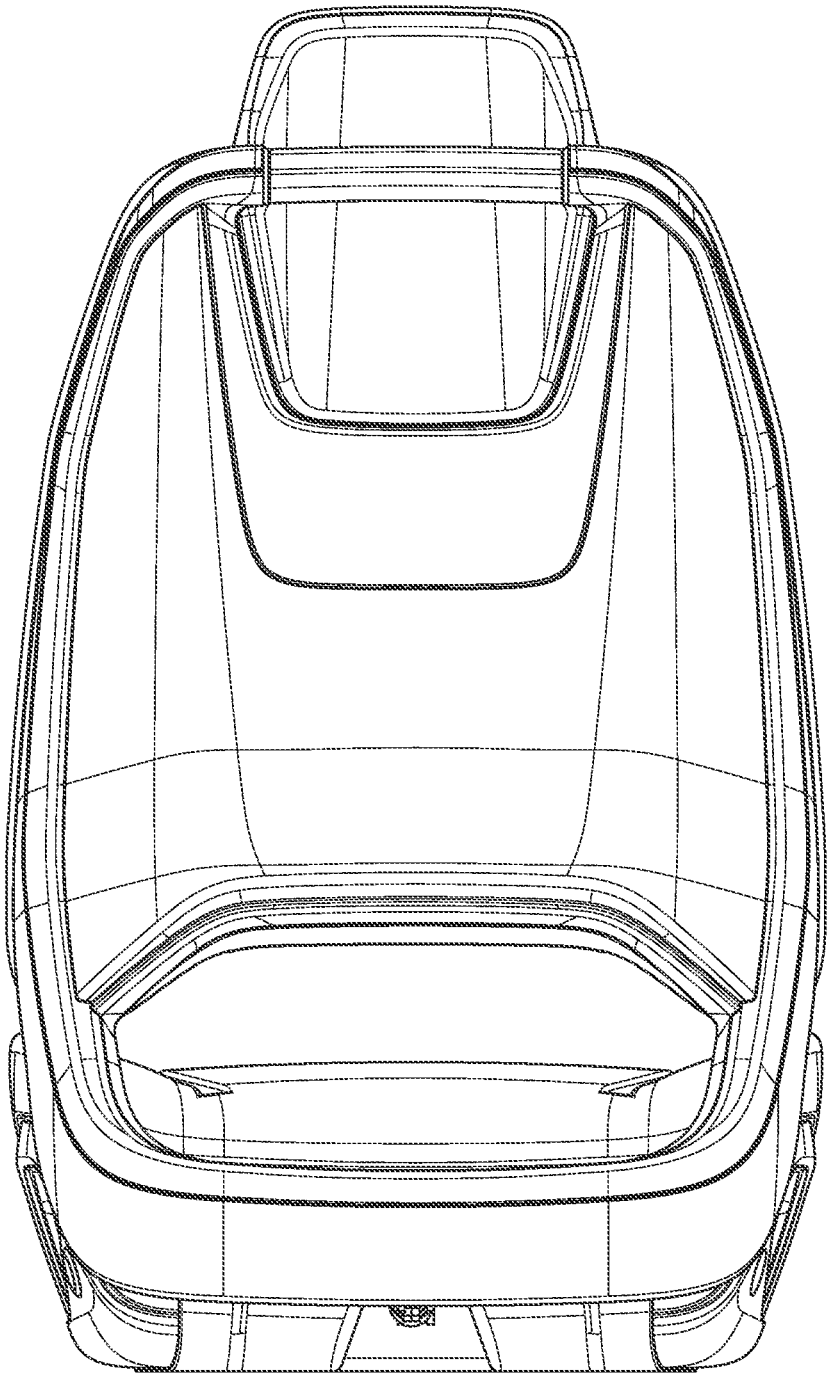
FIG. 18 is a rear view of the marine helm seat of FIG. 14 including ornamental features of the marine helm seat, in accordance with one or more examples of the present disclosure.

FIG. 18 is a rear view of the marine helm seat of FIG. 14 including ornamental features of the marine helm seat, in accordance with one or more examples of the present disclosure.

Figure 19:
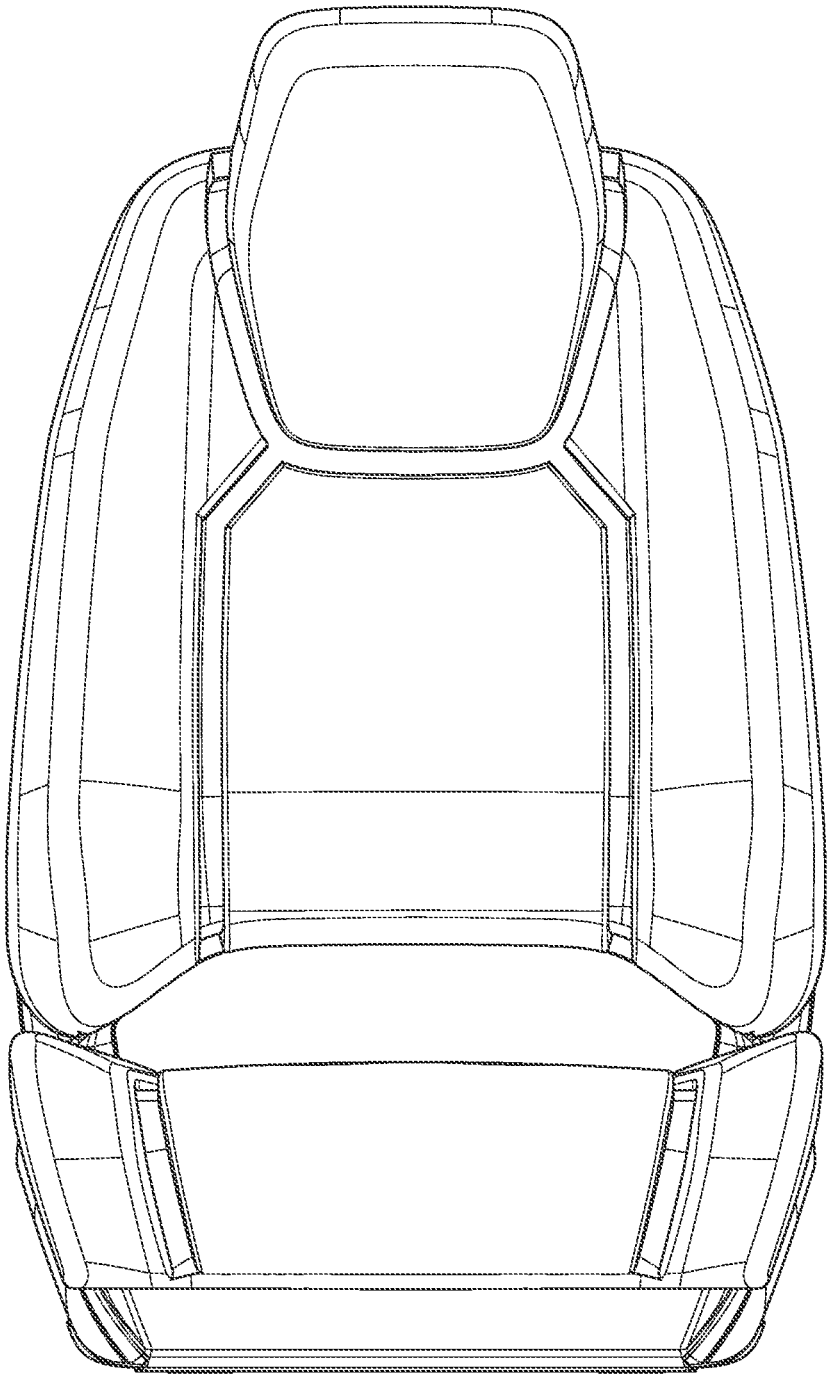
FIG. 19 is a front view of the marine helm seat of FIG. 14 including ornamental features of the marine helm seat, in accordance with one or more examples of the present disclosure.

FIG. 19 is a front view of the marine helm seat of FIG. 14 including ornamental features of the marine helm seat, in accordance with one or more examples of the present disclosure.

Figure 20:
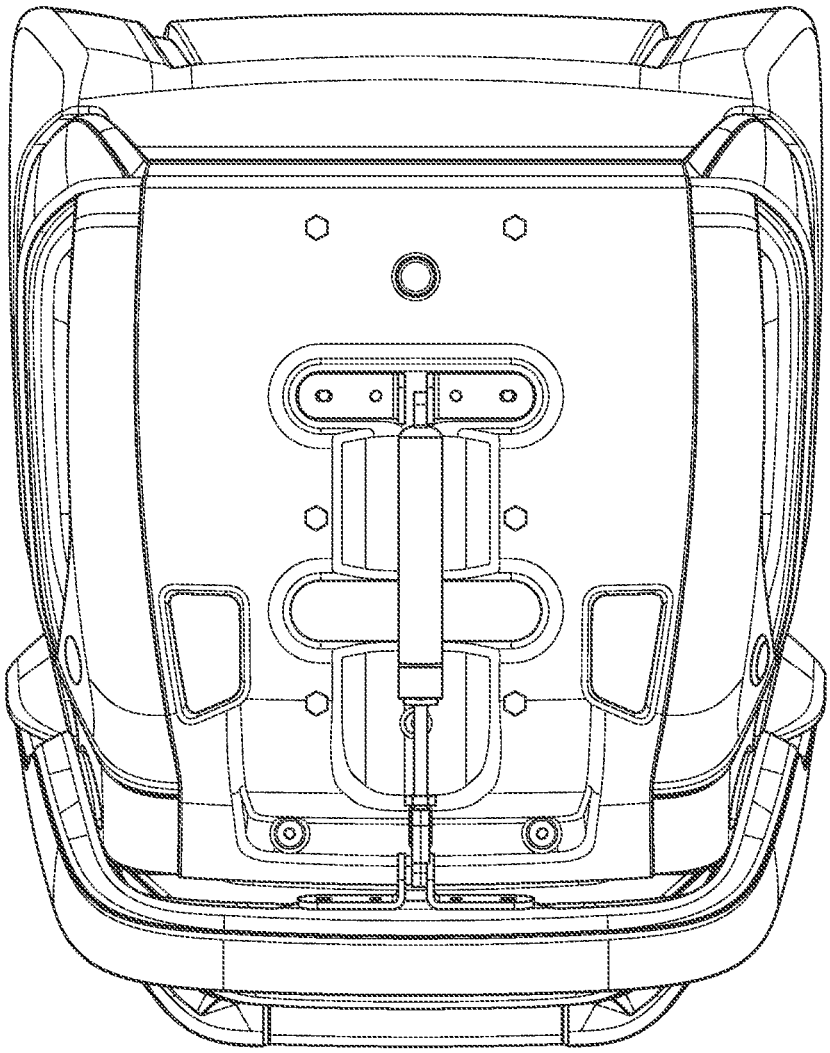
FIG. 20 is a bottom view of the marine helm seat of FIG. 14 including ornamental features of the marine helm seat, in accordance with one or more examples of the present disclosure.

FIG. 20 is a bottom view of the marine helm seat of FIG. 14 including ornamental features of the marine helm seat, in accordance with one or more examples of the present disclosure.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

That which is claimed is:

1. A marine helm seat, comprising:
a seat base positionable within a marine vessel;
a seat back extending from the seat base in an upward direction from a longitudinal axis of the seat base; and
an actuation mechanism configured to recline the seat back in response to a reclining force acting on the seat back and configured to lock the seat back in an occupant selectable position, wherein the actuation mechanism is positioned on an underside of or within the seat base, wherein the seat back comprises:
a frame comprising a set of engagement clips; and
a molded foam carrier comprising a set of cutouts that are configured to removably engage with the set of engagement clips of the frame.

2. The marine helm seat of claim 1, wherein the molded foam carrier comprises a molded carrier with an integral headrest.

3. The marine helm seat of claim 1, further comprising:
a second actuation mechanism configured to recline the seat back in combination with the actuation mechanism in response to the reclining force acting on the seat back, wherein the second actuation mechanism is positioned on an underside of or within the seat base.

4. The marine helm seat of claim 3, wherein the actuation mechanism and the second actuation mechanism are further positioned equidistant from the longitudinal axis of the seat base and on opposite sides of the longitudinal axis.

5. The marine helm seat of claim 1, wherein the actuation mechanism is further positioned along the longitudinal axis of the seat base.

6. A marine helm seat, comprising:
a seat base positionable within a marine vessel;
a seat back extending from the seat base in an upward direction from a longitudinal axis of the seat base;
an actuation mechanism configured to recline the seat back in response to a reclining force acting on the seat back and configured to lock the seat back in an occupant selectable position, wherein the actuation mechanism is positioned on an underside of or within the seat base; and
an actuation trigger configured to lock and unlock the actuation mechanism such that the seat back is lockable at any position within a range of motion of the actuation mechanism, wherein the actuation mechanism comprises a locking gas spring cylinder.

7. The marine helm seat of claim 6, wherein the seat back comprises a frame, wherein an actuating end of the actuation mechanism is coupled to the frame of the seat back using at least one perpendicular bracket to control a reclining or declining movement of the seat back, and wherein a static end of the actuation mechanism is coupled to the seat base using at least one additional perpendicular bracket.

8. The marine helm seat of claim 7, wherein the actuation mechanism is configured to recline the seat back in response to the actuating end of the actuation mechanism retracting toward a static end of the actuation mechanism, and wherein the actuation mechanism is configured to decline the seat back in response to the actuating end of the actuation mechanism extending away from the static end of the actuation mechanism.

9. The marine helm seat of claim 1, further comprising:

a depression running along the longitudinal axis of the seat base, wherein at least a portion of the actuation mechanism is positioned within the depression;

an actuation trigger configured to lock and unlock the actuation mechanism at any position within a range of motion of the actuation mechanism, wherein the actuation mechanism comprises a locking gas spring cylinder;

at least one first perpendicular bracket coupling an actuating end of the actuation mechanism to a frame of the seat back; and at least one second perpendicular bracket coupling a static end of the actuation mechanism to the seat base.

10. An actuation mechanism of a marine helm seat, comprising:

a static end configured to couple to an underside of a seat base or to a portion of the seat base located within the seat base of the marine helm seat positionable on a marine vessel;

an actuating end positioned opposite the static end and configured to couple to a seat back of the marine helm seat; and an actuation trigger configured to enable movement of the actuating end such that the seat back is configured to recline, decline, or both;

a release mechanism configured to release the actuating end from a locked state; and a wire communicatively coupled between the actuation trigger and the release mechanism and configured to provide a first actuating force on the release mechanism to release the actuating end from the locked state in response to a second actuating force applied to the actuation trigger.

11. The actuation mechanism of claim 10, wherein the actuating end of the actuation mechanism is configured to couple to a frame of the seat back using at least one perpendicular bracket, and wherein the static end of the actuation mechanism is configured to couple to the seat base using at least one additional perpendicular bracket.

12. The actuation mechanism of claim 10, wherein the static end and the actuating end are configured to run along a longitudinal axis of the seat base.

13. The actuation mechanism of claim 10, wherein the actuation trigger comprises a plunger trigger.

14. The actuation mechanism of claim 10, wherein the actuating end is configured to recline the seat back by moving toward the static end and to decline the seat back by moving away from the static end.

15. A method of reclining a marine helm seat, comprising:

receiving a first force at an actuation trigger of the marine helm seat;

in response to receiving the first force, transitioning an actuation mechanism to an unlocked state, wherein the actuation mechanism is positioned on an underside of a seat base and is coupled between the seat base and a seat back;

receiving a second force on the seat back;

in response to receiving the second force, moving an actuating end of the actuation mechanism coupled to the seat back toward a static end of the actuation mechanism coupled to the seat base to recline the seat back; and in response to removal of the first force at the actuation trigger, transitioning the actuation mechanism to a locked state.

16. The method of claim 15, further comprising:

receiving a third force at the actuation trigger of the marine helm seat;

in response to receiving the third force, transitioning the actuation mechanism to the unlocked state;

in response to removal of the second force on the seat back, moving the actuating end of the actuation mechanism coupled to the seat back toward the static end of the actuation mechanism coupled to the seat base to decline the seat back; and in response to removal of the first force at the actuation trigger, transitioning the actuation mechanism to the locked state.

17. The method of claim 15, wherein the actuation mechanism comprises at least two locking gas spring cylinders positioned equidistant from a longitudinal axis of the seat base on opposite sides of the longitudinal axis.

18. The method of claim 15, wherein the second force comprises a reclining force that is greater than a biasing force of the actuation mechanism.

* * * * *